US010692348B2

(12) United States Patent
Ruchti

(10) Patent No.: US 10,692,348 B2
(45) Date of Patent: Jun. 23, 2020

(54) DEVICE AND METHOD FOR PROTECTING AGAINST SWIMMING ACCIDENTS, IN PARTICULAR FOR THE EARLY DETECTION OF DROWNING PERSONS, AND THE LIKE

(71) Applicant: BlueArc Finance AG, Alpnach Dorf (CH)

(72) Inventor: Heinz Ruchti, Leutwil (CH)

(73) Assignee: Bluearc Finance AG, Alpnach Dorf (CH)

( * ) Notice: Subject to any disclaimer, the term of this patent is extended or adjusted under 35 U.S.C. 154(b) by 0 days.

(21) Appl. No.: 15/754,655

(22) PCT Filed: Aug. 23, 2016

(86) PCT No.: PCT/EP2016/069845
§ 371 (c)(1),
(2) Date: Feb. 23, 2018

(87) PCT Pub. No.: WO2017/032757
PCT Pub. Date: Mar. 2, 2017

(65) Prior Publication Data

US 2018/0240320 A1 Aug. 23, 2018

(30) Foreign Application Priority Data

Aug. 24, 2015 (DE) ..... 10 2015 011 085

(51) Int. Cl.
*G08B 21/08* (2006.01)
*G08B 7/06* (2006.01)
*G08B 21/02* (2006.01)

(52) U.S. Cl.
CPC ..... *G08B 21/088* (2013.01); *G08B 7/06* (2013.01); *G08B 21/0225* (2013.01); *G08B 21/0291* (2013.01)

(58) Field of Classification Search
None
See application file for complete search history.

(56) References Cited

U.S. PATENT DOCUMENTS 5,091,714 A 2/1992 Solminihac
5,520,486 A 5/1996 Van Wyck
(Continued)

FOREIGN PATENT DOCUMENTS

CN 104824926 8/2015
DE 10116000 10/2002
(Continued)

OTHER PUBLICATIONS

English Translation of International Preliminary Report on Patentability for International (PCT) Patent Application No. PCT/EP2016/069845, dated Mar. 8, 2018, 7 pages.
(Continued)

*Primary Examiner* — Leon Viet Q Nguyen
(74) *Attorney, Agent, or Firm* — Sheridan Ross P.C.

(57) ABSTRACT

The invention relates to a device for monitoring persons in the water, comprising: a carrier apparatus for fastening to a person; a monitoring apparatus held by the carrier apparatus and which has a sensor apparatus and a processor apparatus, wherein the sensor apparatus is connected to the processor apparatus; and a signaling apparatus held by the carrier apparatus and which is connected to the monitoring apparatus, wherein the signaling apparatus has a floatation body and the signaling apparatus is provided for detaching from the carrier apparatus upon a signal of the processor apparatus and rising to the water surface. The invention further relates to a system for monitoring persons in the water, comprising a device for monitoring persons in the water and a base station. The invention further relates to a method and
(Continued)

Figure 1:
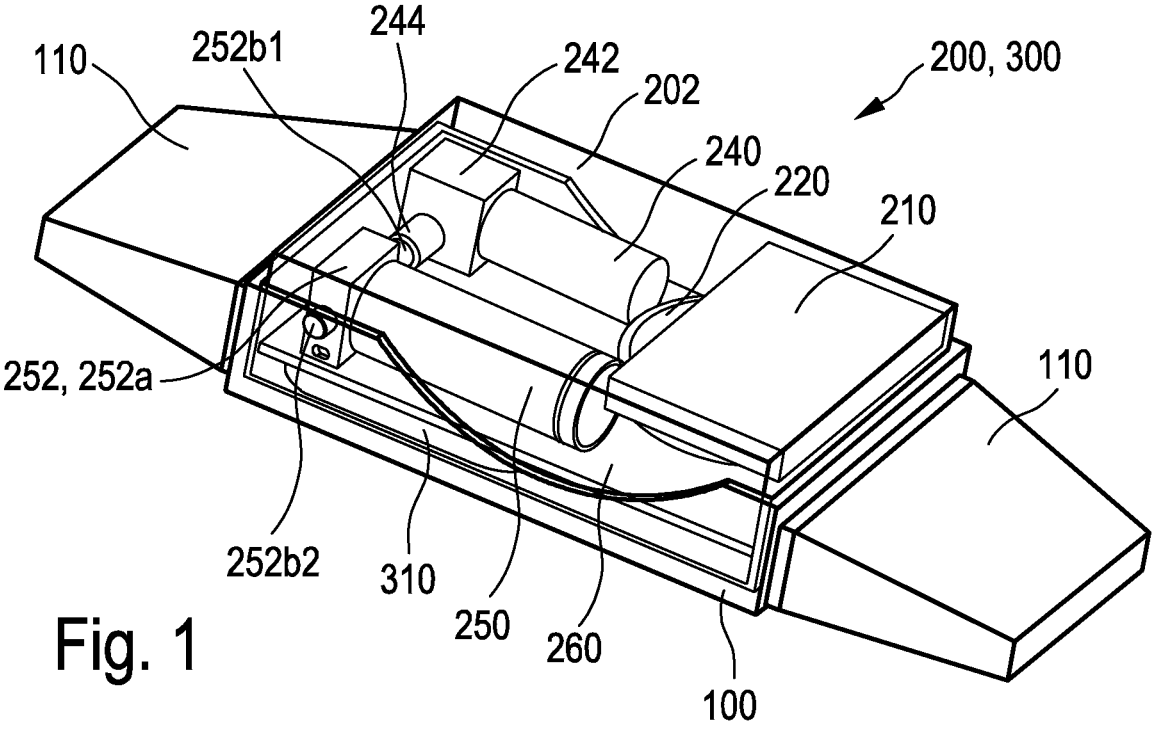

use of the device to protect persons from dangers resulting from a lack of oxygen and drowning.

21 Claims, 13 Drawing Sheets

(56) References Cited

U.S. PATENT DOCUMENTS

| | | | | |
|---|---|---|---|---|
| 7,267,509 | B1 * | 9/2007 | Jackson, III | B63C 9/155 405/186 |
| 9,868,495 | B2 * | 1/2018 | Schechter | G16H 20/30 |
| 2008/0150733 | A1 * | 6/2008 | Snyder | G08B 21/088 340/573.6 |
| 2009/0295566 | A1 * | 12/2009 | Weintraub | G08B 21/088 340/539.11 |
| 2013/0171894 | A1 | 7/2013 | Ashard | |

FOREIGN PATENT DOCUMENTS

| | | |
|---|---|---|
| DE | 102008050558 | 4/2010 |
| EP | 1492069 | 12/2004 |
| ES | 1068634 | 11/2008 |
| JP | S61-229692 | 10/1986 |
| JP | H02-214888 | 8/1990 |
| JP | H03-213494 | 9/1991 |
| JP | 2004-098936 | 4/2004 |
| JP | 2009-544527 | 12/2009 |
| WO | WO 2007/077558 | 7/2007 |
| WO | WO 2008/013489 | 1/2008 |
| WO | WO 2015/087330 | 6/2015 |

OTHER PUBLICATIONS

International Search Report prepared by the European Patent Office dated Aug. 23, 2016, for International Application No. PCT/EP2016/069845.

International Search Report prepared by the European Patent Office dated Oct. 21, 2016, for International Application No. PCT/EP2016/069845.

Official Action with English Translation for Japan Patent Application No. 2018-529724, dated Aug. 19, 2019, 19 pages.

Official Action with English Translation for Japan Patent Application No. 2018-529724, dated Feb. 25, 2020, 17 pages.

Official Action for European Patent Application No. 16758129.7, dated May 8, 2020, 7 pages.

* cited by examiner

DEVICE AND METHOD FOR PROTECTING AGAINST SWIMMING ACCIDENTS, IN PARTICULAR FOR THE EARLY DETECTION OF DROWNING PERSONS, AND THE LIKE

CROSS REFERENCE TO RELATED APPLICATIONS

This application is a national stage application under 35 U.S.C. 371 and claims the benefit of PCT Application No. PCT/EP2016/069845 having an international filing date of 23 Aug. 2016, which designated the United States, which PCT application claimed the benefit of German Patent Application No. 102015011085.3 filed 24 Aug. 2015, the disclosure of each of which are incorporated herein by reference.

The present invention relates to an apparatus and a method for protecting against swimming accidents, in particular for the early detection of drowning persons, and the like.

According to estimates from the blausand.de organization (also see wikipedia.org), more than 20,000 people die every year in Europe in swimming accidents. Yet the number of near-drowning accidents is five times higher on average than the number of fatal drowning accidents, whereby many of these near-drowning accidents result in serious and sometimes irreparable impairment of the victim's health.

Serious swimming accidents are frequently caused by a swimmer or bather losing consciousness in the water—for which there can be many reasons—and this going unnoticed by a third party. Because contrary to popular assumption, a swimmer who has for example exhausted his energy and is therefore under threat of drowning, actually no longer has the necessary strength to draw attention to himself by signaling or shouting. That results in him sinking below the surface of the water unobserved. If consciousness can be restored to a victim in this type of situation within the next two to three minutes, there usually ends up being no consequences of the accident. If rescue occurs between three and five minutes after the loss of consciousness, there is still a high chance of saving the victim's life. As rescue takes longer, the chances of the victim's survival drops at a progressive rate.

A system is known from U.S. Pat. No. 5,091,714 in which a swimmer wears a wrist transmitter with a contact which is closed by the arm being submerged under water. If the arm remains underwater for a predetermined period of time, an acoustic signal is emitted which is received by an underwater microphone. However, one difficulty with this system, e.g. given swimmers of differing abilities and needs, is specifying the period of time after which a swimmer needs to raise his arm out of the water in order to prevent or stop an acoustic signal. Particularly when there are multiple swimmers in an area, it can be confusing which transmitter sent the danger signal. Hence, a certain amount of time can elapse until a continuous signal and thus an emergency is recognized. As a consequence, the time remaining for rescue is shortened. Moreover, in some swimming stroke styles, e.g. the breaststroke, the wrist is often continuously underwater for a long period of time while the head independently surfaces and submerges in the water.

In crowded areas such as e.g. public swimming pools, the reliable detecting of danger signals by receivers is furthermore impeded due to interference signals from various sources.

A monitoring system is known from DE 101 16 000 A1 in which a transmitter likewise located on the wrist of the swimmer continuously emits sound waves beyond the range of human hearing. These sound waves are detected by receivers located above the water's surface. Due to the density of water, the transmitted sound waves are absorbed as the underwater depth of the transmitter increases. An alarm is triggered when a specific transmitter's acoustic signal stops being received. Besides for the transmitter requiring a lot of power, such systems also require careful receiver placement since at increasing horizontal distance of the transmitter from the receiver, the signals of a transmitter located even in shallow water are absorbed.

DE 10 2008 050 558 A1 relates to an apparatus and a method for monitoring waters. The disclosure of DE 10 2008 050 558 A1 is hereby incorporated in its entirety into the disclosure of the present application by reference. The apparatus consists of at least one control unit associated with one person which has at least one sensor device, one analysis device and one transmitter device as well as at least one receiver device situated within the waters and at least one transmission device signal-connected to the receiver device, wherein the transmitter device of the control unit is designed so as to emit signals of a predetermined pattern in case of alarm and the receiver device is designed so as to recognize a case of alarm on the basis of the signal's predetermined pattern and emit an alarm signal.

The receiver device is hereby either fixedly installed in a swimming pool, which limits the system's usability to swimming pools which have such a receiving device installed. Or, alternatively, a portable receiver unit can also be taken along, e.g. by parents, on a pool visit and placed in the water during the time the persons to be monitored who are equipped with the control unit, e.g. children, are swimming.

It is a task of the present invention to provide an efficient apparatus for monitoring persons in water which is in particular of flexible and/or reliable use so as to protect bathers, in particular children, from harm.

This task is solved according to the invention by the apparatus described in claim 1. A system according to the invention constitutes the subject matter of claim 14. A method according to the invention for the monitoring of persons in water constitutes the subject matter of claim 16. Advantageous further developments constitute the subject matter of the subclaims.

According to one aspect of the present invention, an apparatus for monitoring persons in water comprises: a carrier device intended to be fastened to a person, a monitoring device accommodated by the carrier device which has a sensor device and a processor device, wherein the sensor device is connected to the processor device, and a signaling device accommodated by the carrier device and connected to the monitoring device, wherein the signaling device has a flotation body and wherein the signaling device is provided, in particular configured to at least partly, in particular completely, detach from the carrier device and rise to the surface of the water upon a signal of the processor device.

Within the meaning of the invention, an "apparatus for monitoring persons in water," referred to as "apparatus" in the following for short, is understood as a system which is affixed to a person to be monitored and which is provided to monitor one or more parameters from which the apparatus can draw conclusions as to whether the person to whom the apparatus is affixed is in an emergency and, in case of emergency, emit a suitable signal so as to alert other persons to the emergency, particularly persons in the immediate vicinity, so that they will be able to help the endangered person.

Within the meaning of the invention, a "carrier device" is understood as any form of device which is suitable to be affixed to a person to be monitored, in particular a child, particularly to an arm and/or a leg and/or around the neck and/or to part of the swimsuit, and which is provided to in particular detachably accommodate and/or in particular detachably affix therein and/or thereto the devices also described below as being essential to the apparatus such as e.g. the monitoring device and the signaling device.

Within the meaning of the invention, a "monitoring device" is to be understood as a device provided to determine a state of the person being monitored, in particular their length of stay in the water itself and/or their depth in the water and/or a length of time, by means of one or more sensors, compare the state to previously defined limit values, and prompt an alarm upon the exceeding or falling short of the limit valve(s) which is however not emitted by the monitoring device itself but rather by the signaling device.

Within the meaning of the invention, a "sensor device" is to be understood as a device consisting of at least one receiver, in particular a transducer as defined by DIN 1319-1, which responds directly to a measured variable. Furthermore, the "sensor device" as defined by the present invention can comprise, inter alia, further measuring chain elements such as for example an amplifier, analog/digital converter, encoder, etc.

Within the meaning of the invention, a "processor device" is to be understood as a device provided to receive signals, in particular electrical signals, process them, and emit signals, in particular electrical signals. Preferentially, a processor device in the sense of the present invention is an electronic circuit having a central processing unit (CPU), further preferably, the processor device is at least in part realized in an integrated circuit (IC).

Within the meaning of the invention, a "signaling device" is to be understood as a device provided to indicate the person being monitored in the event of emergency. This can ensue for example solely by the flotation body, in particular designed in signal colors, floating on the surface of the water. Said indicating can furthermore occur, in particular additionally, with audible and/or visual, e.g. flashing light, signals.

All possible forms of the verb "have" are to be understood in the sense of the present invention as respectively being non-exhaustive enumerations.

The devices described in the context of the present invention such as the carrier device, sensor device, monitoring device, etc. are not necessarily to be understood as structural units but merely as functional units.

The apparatus according to the invention is in particular advantageous since it is the first time an apparatus is provided which can be used regardless of the local circumstances in any type of water, e.g. pool, outdoor pool, public pool, lake, river or sea. No additional infrastructure, such as e.g. a power supply and/or a base station, is necessary at the swimming location. That, however, explicitly does not rule out the inventive apparatus from being integrated into a corresponding system with a base station in order to, in particular additionally, receive a signal emitted by the signaling device and emit it and/or another signal able to alert a wider group of people to the emergency, in particular supervisory personnel, respectively carrying or wearing a corresponding receiver device.

The inventive apparatus is furthermore advantageous since the entire apparatus as a whole does not need to rise to the surface of the water in an emergency but rather only those components needed in indicating the emergency, in particular the signaling unit.

The apparatus can be easily affixed to the person to be monitored, in particular detachably, particularly by means of a safety closure unable to be released by (small) children.

Moreover, the apparatus not only alerts selected persons such as e.g. lifeguards or parents to the emergency but rather all persons within eyeshot and/or earshot, which can considerably shorten the response time.

When using the inventive apparatus, the persons being monitored, for example toddlers, wear an apparatus unit on their wrist which is in particular no larger than a wristwatch. When using the apparatus in public pools, it is preferentially integrated into the locker key wristband as typically used in such places.

According to one implementation of the apparatus, the monitoring device measures the pressure, in particular water pressure, chronologically acting on the sensor device as a relevant parameter. Preferably, the sensor device also measures parameters related to the wearer such as, for example, the movements of the apparatus.

According to one implementation, the apparatus further comprises additional devices such as a display of the current battery state and/or the operational readiness of the apparatus or other considerations at least not primarily serving safety purposes. These can for example be electronic key systems or cashless payment systems for which preferentially an RFID transponder or the like can be integrated into the apparatus. To display stored information related for example to the monitoring system or payment function or the battery level, a display screen is preferably integrated into the apparatus.

According to one implementation, the apparatus is provided to determine the existence of an emergency situation depending on the individual characteristics of the wearer under respectively different external conditions. This can for example thereby be apparatus respectively configured for small children, non-swimmers, recreational swimmers or competitive swimmers. The monitoring device of the apparatus thereby preferentially deduces the presence of an emergency as a function of a specific length of time the apparatus spends below a predetermined depth of water. When the sensor device of the apparatus also detects the movement of same, a longer period of motionlessness can then likewise be a criterion for there being an emergency.

For example, in the case of a swimmer wearing the apparatus on his wrist, a positive pressure of at least 0.1 bar for a period longer than 45 seconds defines an emergency. A 0.1 bar positive pressure prevails at water depth of one meter. Reaching a water depth of one meter or more wearing the apparatus on the wrist is normally only possible when the swimmer's head is far below the surface of the water. Therefore, in the context of normal swimming situations, it is virtually impossible for the apparatus to be subjected to a positive pressure of 0.1 bar for an extended period of time. Since such a positive pressure can also be momentarily caused by the swimmer's movements in the water or by an intentional dive, an emergency is preferably then only assumed when said positive pressure last for a predetermined longer period of time which, however, still poses no threat to the swimmer of unnecessarily shortening the window of time for rescue. This period as well as the relevant positive pressure are preferentially specified according to the individual characteristics of the person to be monitored.

It is preferably possible to specify the parameters defining an emergency and the values associated therewith for the apparatus as a function of a person's physical characteristics or abilities. Preferably, the apparatus is designed such that the values of a parameter defining an emergency can be specified for example also and/or only by supervisory personnel, in particular parents of (small) children. An appropriate configuration can either be made on the apparatus itself via control elements or by means of a connectable configuration unit such as for example a computer.

According to one implementation, the flotation body is a balloon to be filled with a gas. Preferentially, the balloon comprises an elastomer or a plurality of elastomers, in particular a polymer dispersion and, particularly preferentially, a latex material. Preferentially, the material(s) used for the balloon exhibit(s) a resistance, in particular insensitivity to chlorinated water and/or salt water. According to one implementation, all the elements of the apparatus for monitoring persons exhibit resistance, in particular an insensitivity to chlorinated water and/or salt water.

Conceivable as the gas are any gases which allow the flotation body and, if applicable, devices affixed, in particular non-detachably affixed thereto, to rise to the surface of the water.

This is in particular advantageous since in the filled state, the balloon exhibits an excellent ratio of dead weight to displacement in the water, whereby buoyancy is increased. Alternatively, this good ratio of dead weight to displacement in the water can be used to reduce the overall size of the balloon, which in turn can benefit smaller apparatus design.

According to one implementation, the apparatus further comprises an actuator connected to the flotation body and which is provided to bring the flotation body from a first state, in which the flotation body is not buoyant, into a second state in which the flotation body is buoyant.

Within the meaning of the present invention, an "actuator" is to be understood as a device which is provided to bring the flotation body from the first state into the second state through an active process, in particular by enabling a gas-conducting connection to the flotation body, e.g. in the form of a controlled or regulated valve or in the form an apparatus for breaking a seal. This is in particular advantageous since the flotation body therefore does not need to be able to rise to the water surface the entire time but only when there is an emergency. If the flotation body is for example in the form of a balloon, it is initially provided in the non-deflated state and is not filled with gas until an emergency.

This allows a smaller configuration which it makes possible for the first time to provide an apparatus of the above-described type, particularly for attachment to the arm, in particular at a size roughly comparable to a wristwatch.

According to one implementation, the apparatus further comprises a pressure tank and the actuator (a) comprises a pyrotechnic device provided to enable a gas-conducting connection between the pressure tank and the flotation body upon a signal from the processor device; and/or (b) a drive device, in particular a motor, provided to enable a gas-conducting connection between the pressure tank and the flotation body upon a signal from the processor device.

Within the meaning of the present invention, a "pyrotechnic device" is to be understood as a device configured to be electrically and/or optically and/or chemically ignited upon a signal from the monitoring device. After being ignited, the pyrotechnic substance at least partially burns from the release of gas.

According to one implementation, the pyrotechnic device is a receptacle containing a pyrotechnic substance designed to utilize the resulting gas following the igniting of the pyrotechnic substance to enable a gas-conducting connection, in particular from the pressure tank to the flotation body, so that at least some, in particular all of the gas which is at least not exclusively the gas produced by means of the pyrotechnic device is directed into the flotation body.

Preferentially, the pyrotechnic component comprises a mini-detonator and/or a pyrotechnic mini-fuse assembly. According to one implementation, the pyrotechnic component is ignited electrically, in particular by a voltage of more than 5 V, preferentially in particular at least approximately 12 V.

Implementation (a) is particularly advantageous since a comparatively simple actuator structure having a very fast response time is thereby achieved.

According to one implementation, the pyrotechnic device is electrically ignited, in particular by a voltage of 12 V. According to one implementation, the battery of the apparatus for monitoring persons has a battery, in particular a button cell having an operating voltage of 3 V. The applicant has discovered that power can also be drawn at a higher voltage, in particular 12 V, from such a battery for a short period of time in order to ignite the pyrotechnic device.

This is particularly advantageous since a small-scale button cell can thus be used for normal operation while still, however, being capable of igniting the pyrotechnic device in the case of emergency.

Implementation (b) is particularly advantageous since only one energy source, particularly in the form of a battery, in particular a button cell, is needed which can particularly preferentially be replaced without any special tools and without specialized skills and in particular without endangering the operational reliability of the apparatus. Furthermore, this implementation is particularly advantageous since in particular the motor is substantially age-resistant and thus no inspection of same is necessary, preferentially for the entire operating life of the apparatus.

According to one implementation, the apparatus further comprises a gas feed device having:

(a) a pressure tank provided to take in pressurized gas and feed it to the flotation body upon a signal of the processor device; and/or (b) a container provided to take in a liquid gas which at least partly, in particular completely changes into the gaseous state upon a signal of the processor device and is fed to the flotation body; and/or (c) a pyrotechnic component provided to burn upon a signal of the processor device and feed the thereby resulting gas to the flotation body; and/or (d) a powdered and/or solid first substance provided to come into contact with a second substance upon a signal of the processor device, whereby a gas is produced which is fed to the flotation body.

Within the meaning of the invention, a "gas feed device" is understood as a device having at least one element for providing and/or storing and/or conveying gas.

Implementation (a) is particularly advantageous since no further apparatus is necessary to discharge the gas to the flotation body because under Le Chatelier's principle, the pressurized gas expands into the flotation body of its own accord until the entire system is at uniform pressure.

In particular (ambient) air is conceivable as the gas according to this implementation since it is virtually unlimited and only needs to be compressed during apparatus manufacture. Furthermore, noble gases, in particular helium, neon, argon, krypton, xenon and/or mixtures thereof can also be used. According to one implementation, the pressure tank holds the gas at a pressure of at least 10 bar, in particular at least 50 bar, in particular at least 100 bar, in particular at least 200 bar, in particular at least 400 bar.

This is particularly advantageous because under Boyle-Mariotte's law, the higher the pressure of the gas within the pressure device, the smaller the pressure device can be constructed in order to fill the same flotation body volume.

According to one implementation, the pressure tank is provided to detect the pressure in the pressure tank at predefined intervals or continuously and to relay this to the monitoring device.

This is in particular advantageous since the apparatus itself thus regularly monitors its own operational readiness automatically. An inspection cycle; i.e. an inspection of the apparatus, particularly by trained personnel, can thus be significantly extended. Preferentially, an inspection can be completely eliminated over the course of the apparatus operating life.

Within the meaning of the present invention, a "liquid gas" is to be understood as a gas which remains liquid at ambient room temperature under comparatively low pressure of up to no more than 100 bar maximum. A liquid gas in the sense of the present invention is in particular a gas comprising ethane and/or propane and/or butane or any mixture of at least two thereof, in particular consists of ethane and/or propane and/or butane or a mixture of at least two thereof.

Implementation (b) is particularly advantageous since an even higher filling medium density can thus be achieved prior to the flotation body being filled. Thus, for example, a 1 $cm^3$ volume of liquid gas in the gaseous state can be suitable for filling a 250 $cm^3$ flotation body volume. Moreover, the container only needs to be configured for comparatively low pressures of up to 200 bar (incl. safety reserve).

Within the meaning of the present invention, a "pyrotechnic component" is to be understood as a pyrotechnic substance configured to ignite electrically and/or optically and/or chemically upon a signal from the monitoring device. After igniting, the pyrotechnic substance at least partially burns by releasing gas.

According to one implementation, the pyrotechnic substance is disposed in a container connected in gas-tight manner to the flotation body, in particular via the gas outlet, such that the gas produced during or respectively after the ignition of the substance is at least partially, in particular completely, directed into the flotation body.

Preferentially, the pyrotechnic component comprises a mini-detonator and/or a pyrotechnic mini-fuse assembly. According to one implementation, the pyrotechnic component is ignited electrically, in particular by a voltage of more than 5 V, preferentially in particular at least approximately 12 V.

Implementation (c) is particularly advantageous since the risk of the pressure tank losing pressure can be excluded, which can significantly extend an inspection cycle; i.e. an inspection of the apparatus, particularly by trained personnel. Preferentially, an inspection can be completely eliminated over the course of the apparatus operating life.

According to one implementation, the pyrotechnic component is electrically ignited, in particular by a voltage of 12 V. According to one implementation, the battery of the apparatus for monitoring persons is a battery, in particular a button cell, having an operating voltage of 3 V. The applicant has discovered that power can also be drawn at a higher voltage, in particular 12 V, from such a battery for a short period of time in order to ignite the pyrotechnic device.

This is particularly advantageous since a small-scale button cell can thus be used for normal operation while still, however, being capable of igniting the pyrotechnic device in the case of emergency.

The powdered and/or solid first substance preferentially comprises sodium tartrate, a sodium salt of tartaric acid having the molecular formula of $C_4H_4O_6Na_2$, as is found, inter alia, in bound form in many fruits. The second substance is preferentially a liquid substance, in particular a substance containing water, particularly at least substantially water, in particular water. Water encompasses in this context both fresh as well as saltwater as is found in natural areas suitable for swimming or in man-made facilities.

When the two substances come into contact, a chemical reaction begins, producing at least one gaseous component.

Implementation (d) is in particular advantageous since it is of very simple structure and the powdered and/or solid first substance contained in the apparatus is non-combustible and/or poses no health risk, in particular to children.

According to one implementation, the signaling device is provided to emit an audio signal and/or a visual signal and/or a radio signal as soon as the signaling device is at least partly, in particular completely detached from the carrier device at the surface of the water.

This is particularly advantageous since it thereby further intensifies the effect of the flotation body floating on the water's surface in an emergency and actively directs the attention of other persons in the surrounding area of the endangered person to the emergency.

According to one implementation, a visual signal is a beacon, in particular a flashing signal, in particular a flash-like signal generated at intervals.

According to one implementation, the signaling device is provided to emit an audio signal audible to the human ear, in particular at a volume of at least 80 decibels, preferentially at least 90 decibels, and further preferentially at least 100 decibels.

In one preferential embodiment, the audio signal has a frequency in the range of from 50 Hz to 10 kHz. A frequency range of from 2 kHz to 10 kHz and in particular 3 kHz to 5 kHz has thereby shown particularly suitable in terms of reach and energy consumption.

This is in particular advantageous since an audio signal will be perceived regardless of the direction a person in the surrounding area of the endangered person is looking. This thus at least encourages, in particular ensures, an immediate focusing of the attention of the persons in the surrounding area of the endangered person.

According to one implementation, the signaling device comprises a vibrating body, in particular a ferroelectric vibrating body, particularly in the form of a piezo element, which produces a sound able to be perceived by the human ear.

This is in particular advantageous since a vibrating body is capable of producing a corresponding sound pressure able to be perceived by persons in the surrounding area of the endangered person as sound or noise.

According to one preferential implementation, the vibrating body is attached to the flotation body in such a way that the flotation body acts as a resonating body which modifies, in particular intensifies, the effect of the vibrating body.

According to one implementation, the apparatus further comprises a protective cover which is arranged on the carrier device and which covers at least the signaling device, in particular at least the signaling device and the monitoring device, in particular so as to be permeable to water, wherein the protective cover is provided to at least partly, in particular completely, disengage from the carrier device upon a signal from the monitoring device so that at least the signaling device is exposed after the at least partial disengaging.

This is in particular advantageous because the sensitive components of the apparatus, in particular the monitoring device and the signaling device, and most particularly the at times sensitive flotation body, are thus always protected during use—aside from an emergency—from the effects of force and/or solar radiation.

Upon an emergency, the protective cover uncovers at least the signaling device so that it can subsequently disengage from the carrier device and rise to the water's surface.

The water permeability enables the sensor device, in particular a pressure sensor device, which is provided to determine the surrounding water pressure as a measure of the depth of the monitored person in the water, to be disposed underneath the protective cover in such a manner that the sensor device is also protected by the protective cover as well and yet still able to take meaningful measurement readings.

According to one implementation, the apparatus comprises a further actuator which is provided to at least partially, in particular completely, uncover and/or at least partially, in particular completely, disengage the protective cover from the carrier device upon a signal of the monitoring device.

This is in particular advantageous since the protective cover can thus be designed so as to be firmly attached to the carrier device in the absence of emergency and the risk of accidental detaching at least reduced, in particular excluded.

According to one implementation, the protective cover is at least partly, in particular completely, detached from the carrier device by the flotation body, in particular in the course of the balloon inflating.

According to one implementation, the actuator and the further actuator are formed by one common actuator device.

This is in particular advantageous since this thus allows dispensing with additional components which take up available space and entail costs as well as introduce additional potential for error. In particular, the actuator comprises a moving component which on the one hand locks the protective cover in place while there is no emergency and, on the other, closes off the pressure tank and is displaced upon an emergency, wherein the protective cover is at least partly detached and the pressure tank opened toward the flotation body.

According to one implementation, the sensor device is a sensor device, in particular a pressure sensor device, which is provided to supply a signal from which the monitoring device can directly deduce or indirectly calculate whether, and in particular how deep, the person is in the water.

This is particularly advantageous since it can be concluded from the sensor device's depth in the water whether the head of the person being monitored is still above the surface of the water or not.

One preferential measure for determining the depth is the water pressure since same increases 1 bar for every 10 meters of water depth compared to the air pressure prevailing directly above the surface of the water.

According to one implementation, the sensor device of the apparatus additionally determines the air pressure directly above the water surface; i.e. in the area of up to 2 meters, and the monitoring device determines the difference between the air pressure directly above the water surface and the surrounding pressure in the water in order to enable a more accurate estimate of the depth of water at which the sensor device is located.

According to one implementation, the monitoring device comprises a time-measuring device, wherein the monitoring device is provided to start tracking time upon a signal, in particular predefined signal, of the sensor device.

According to one implementation, the predefined signal of the sensor device is a measured value above or respectively below a predefined threshold; i.e. in the danger zone.

This is particularly advantageous since only thus registered is the specific time interval during which the sensor device and thereby the associated apparatus, and thus the associated person being monitored, is in a danger zone, in particular below a predefined maximum water depth. Time tracking is deactivated in other operating states of the apparatus which results in energy savings and is thus related to prolonging the service life, in particular the battery life.

To a certain degree, depth alone is not an exclusive indicator of emergency, at least with experienced swimmers. But if the monitored person remains below the predefined maximum depth for too long, an emergency can thus be concluded.

According to one implementation, the monitoring device transmits the signal to the signaling device which prompts the signaling device to at least partially, in particular completely detach from the carrier device and rise to the surface of the water when a time period determined in the course of the time measurement exceeds a predefined length.

This is in particular advantageous since an alarm is thus only triggered in the case of emergency, i.e. when the monitored person continuously remains below a predefined maximum water depth for longer than a predefined maximum period of time.

Upon again falling short of the predefined maximum depth; i.e. the monitored person being back in a permissible depth before the maximum time period having been exceeded, the time tracking is aborted without an alarm being triggered.

According to one implementation, the signaling device further comprises a cord-like element which connects the signaling device and the carrier device together, even when the signaling device is substantially detached from the carrier device at the surface of the water.

This is in particular advantageous since the monitored person can thus be found faster, in particular in murky waters such as for example rivers or seas, even if the water turbidity and/or the depth of the monitored person under the water does not allow said monitored person to be spotted directly or only insufficiently spotted from the surface of the water.

According to one implementation, the carrier device and/or the base device comprises a localization device. This is in particular provided, in particular configured, to locate the person being monitored faster in the event of emergency, particularly when the water turbidity and/or the depth of the monitored person under the water does not allow said monitored person to be spotted directly or only insufficiently spotted from the surface of the water. According to a further development, the localization device comprises a source of noise and/or light. Examples of light sources are LEDs, particularly high-power LEDs which are in particular configured to emit a flashing light signal.

According to one implementation, the alarm body and/or the signaling device are provided, in particular configured, to separate from the base device and/or the monitoring device, in particular by a larger volume of the flotation body being used to build up a force in relation to a part of the base device and/or the monitoring device while the flotation body is being conveyed into the buoyant state, in particular during inflating, which is used to effect a separation of the alarm body and/or the signaling device from the base device and/or the monitoring device. This is in particular advantageous since additional components can be dispensed with for the disengaging and/or separating, thereby simplifying the structure of the apparatus.

According to one implementation, the ferroelectric vibrating body is in gas-conducting connection with an interior space of the flotation body. This is particularly advantageous since at least part of the sound produced by the ferromagnetic vibrating body can thereby be emitted above the surface of the water as soon as the alarm body has risen to the water surface in an emergency. In particular, a lossy sound transmission from the water to the air is prevented at the water surface.

According to one implementation, the carrier device comprises a wristband exhibiting a closure device, the operation of which for example requires an additional aid such as a positive locking tool (key) or information such as for example a number combination.

This is in particular advantageous since such a device can for example prevent small children from taking off the apparatus.

According to a further aspect of the present invention, a system for monitoring persons in water comprises: an apparatus in accordance with one of the above-described implementations and a base station provided to detect the signaling device at the surface of the water by means of a receiver device and provided to emit a further audio signal and/or a further visual signal and/or a further radio signal by means of a transmitter device.

Within the meaning of the invention, a "system for monitoring persons in water" is understood as a system consisting of at least one apparatus for monitoring persons in water and at least one base station which are configured in such a way as to at least unidirectionally communicate with each other.

Within the meaning of the invention, a "base station" is understood as any device provided to detect a signaling device itself and/or a signal, in particular audio signal, of the signaling device and indicate the emergency, additionally to the signaling device, via an audio signal and/or a visual signal and/or a radio signal and/or an electrical signal.

This is in particular advantageous as it heightens the effect of the apparatus in alerting persons in the surrounding area of the monitored person to the emergency of the person being monitored.

According to one implementation, the base station is further capable of also emitting a distress call to more distant locations such as e.g. rescue and/or water rescue services and/or fire departments and/or police stations and/or medical emergency services.

According to one implementation, the base station is provided to receive an audio signal and/or a visual signal and/or a radio signal from the signaling device by means of the receiver device, in particular whereby the signal, in particular the audio signal, is a signal at a predefined frequency and the base station is in particular provided to substantially only be responsive to a signal at said predefined frequency or in a predefined frequency range respectively.

This is in particular advantageous since on the one hand, the risk of base station false alarms is thereby reduced and, at the same time, the probability of an actual emergency being detected is increased.

According to one implementation, the system comprises one or more such base stations which are preferably arranged at the pool or at the swimming area of a larger body of water respectively such that the signals emitted by an apparatus will be received without interference regardless of the whereabouts of the person being monitored. A plurality of base stations are thus preferably arranged particularly in the case of larger pools or beach areas.

According to a further aspect of the present invention, a method for monitoring persons in water comprises the steps, in particular in the following order:

- S1 fastening an apparatus for the monitoring of persons in water of the type described above in different implementations onto a person;
- S2 the sensor device detecting whether, in particular how deep, the person is in the water;
- S3 a time-measuring device of the monitoring device detecting how long the person remains in the water, in particular below a predefined depth;
- S4 an emergency being determined as soon as the person remains in the water for longer than a predefined length of time, in particular below a predefined depth, in particular continuously;
- S5 the signaling device at least partly, particularly completely, detaching from the carrier device upon a signal of the monitoring device;
- S6 the signaling device rising to the surface of the water; and in particular
- S7 the signaling device emitting an audio signal and/or a visual signal and/or a radio signal.

With respect to the advantages and further embodiments of the method, reference is made to the remarks provided above on the apparatus which thereby apply similarly to the method.

According to one implementation, the apparatus is not activated until said apparatus is in the water. This can for example be achieved by a contact switch provided on the apparatus which actively switches the monitoring function on as soon as the apparatus is in the water.

A further aspect of the present invention relates to the use of an apparatus for monitoring persons in water of the type described above in different implementations and/or a system of the type described above in different implementations for protecting persons, in particular children, from dangers posed by lack of oxygen, in particular from drowning.

Figure 2:
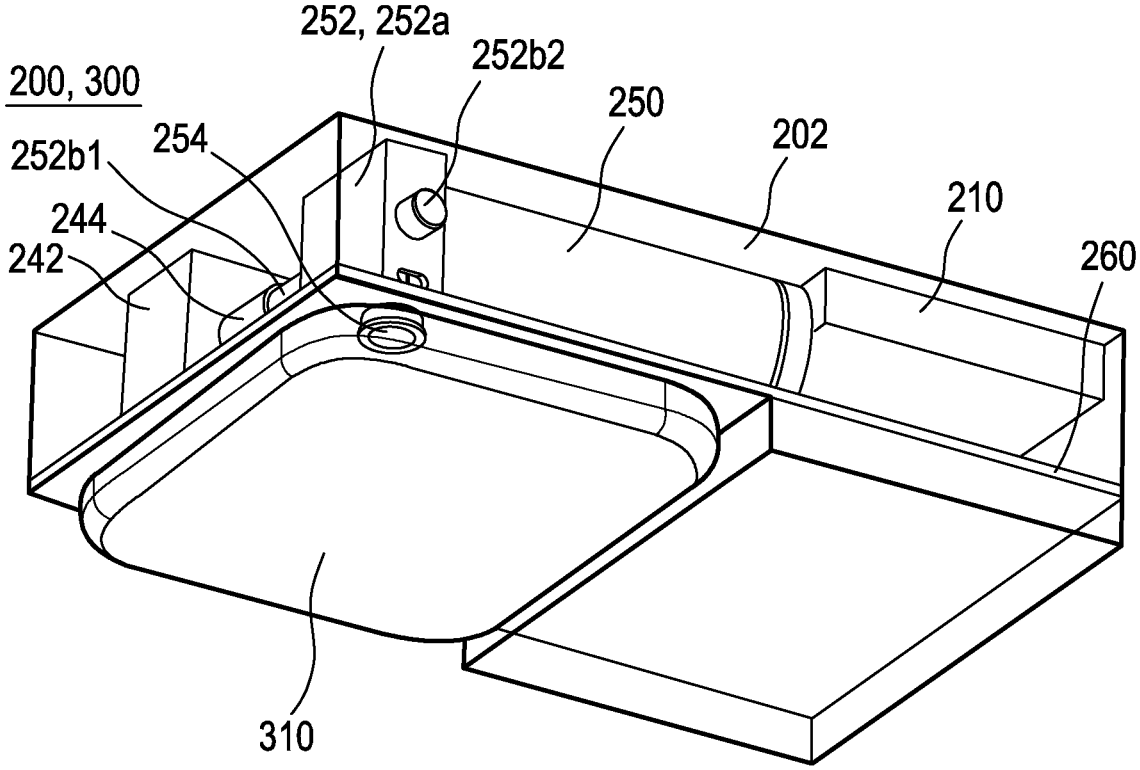
Figure 3A:
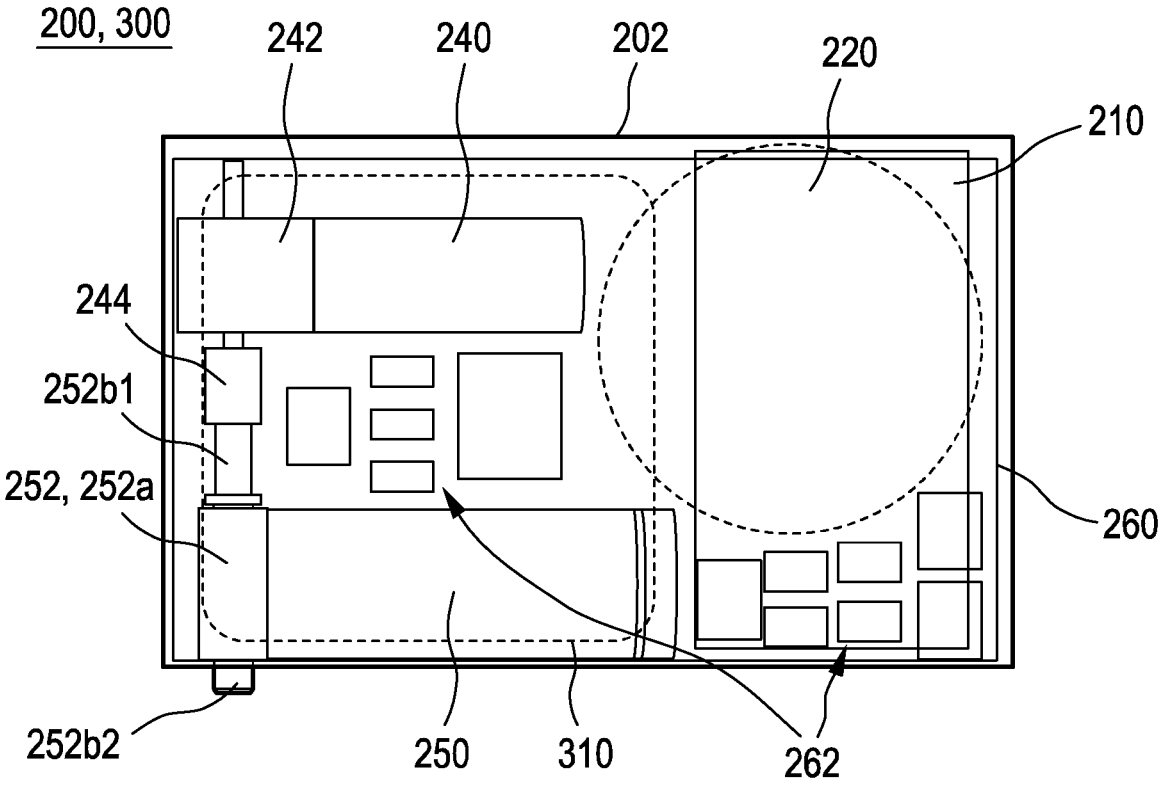
Figure 3B:
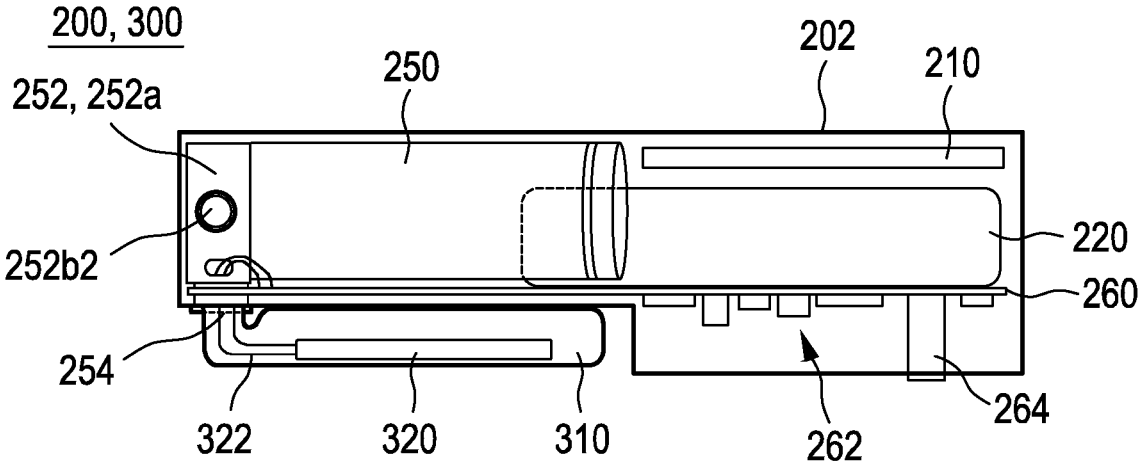
Figure 4:
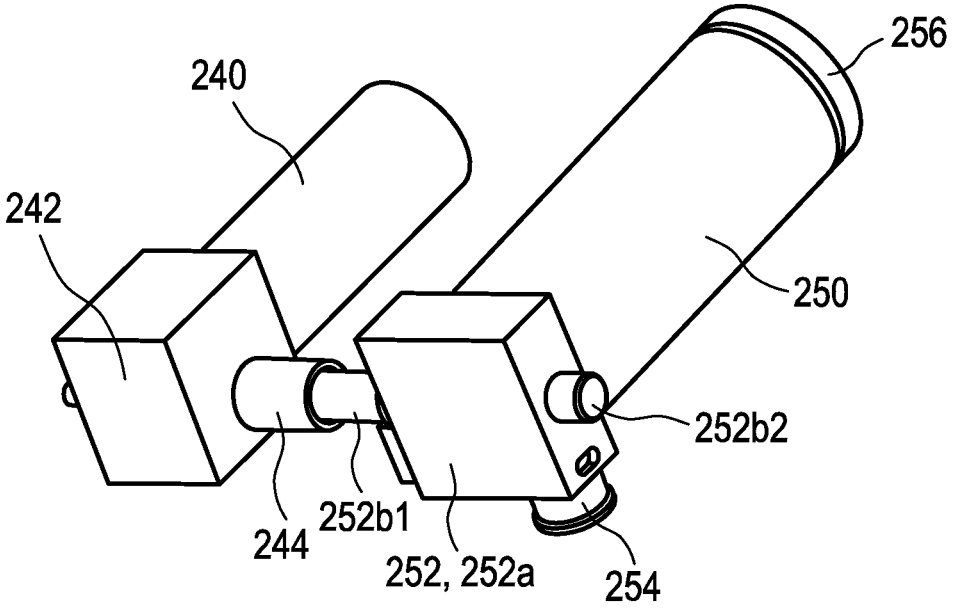
Figure 5:
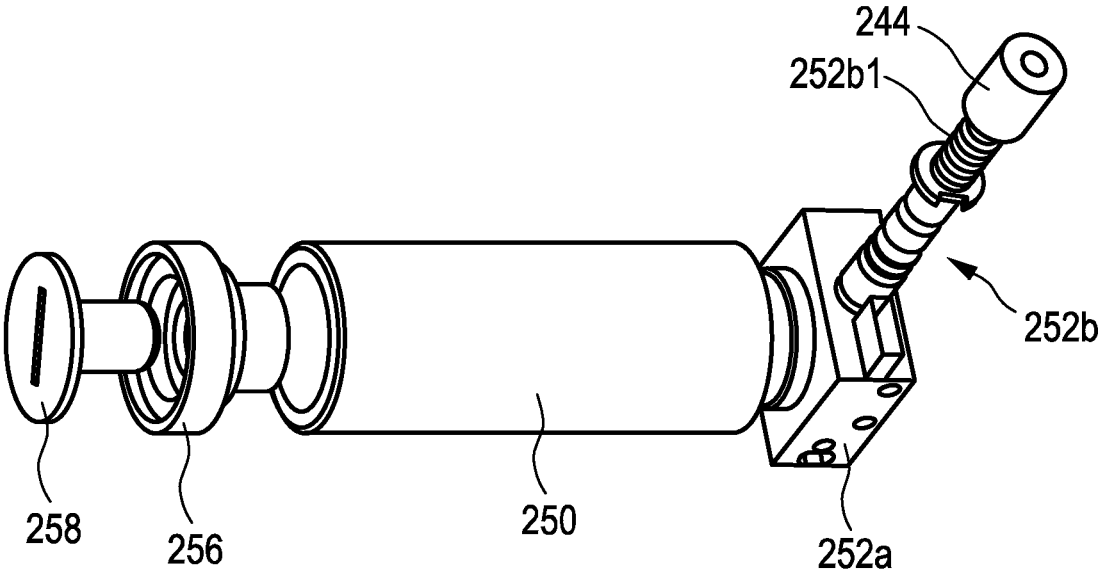
Figure 6:
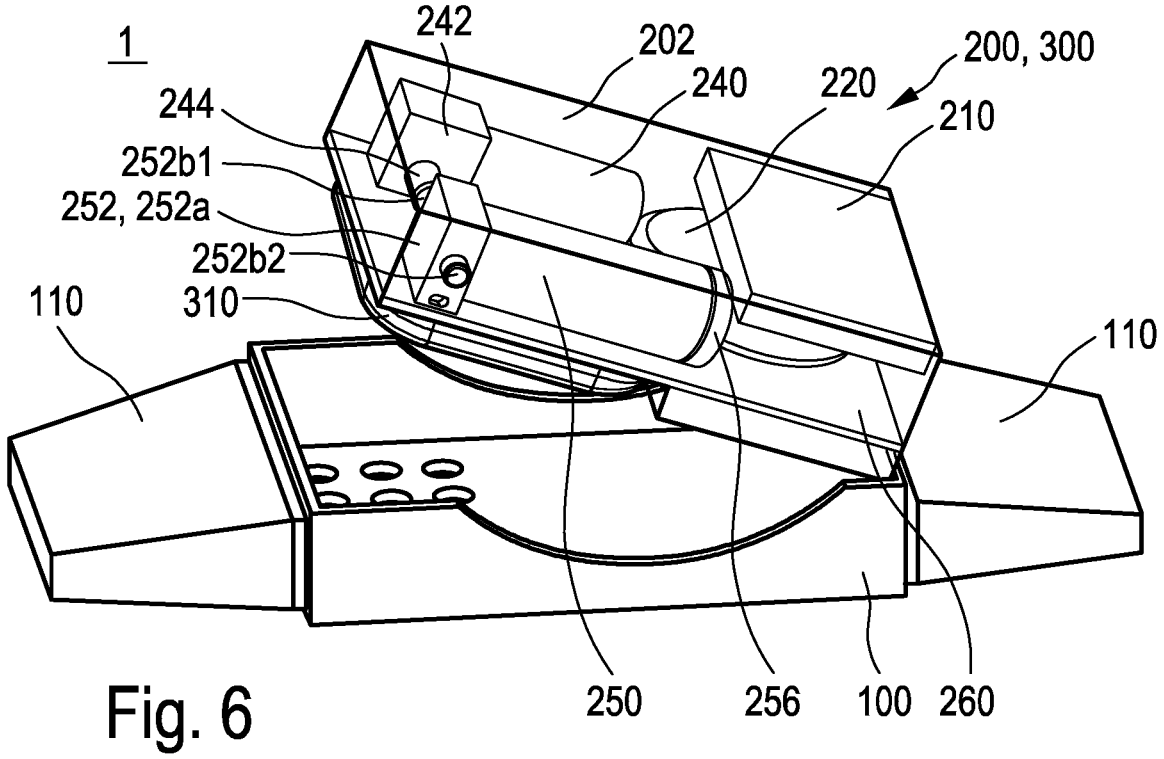
Figure 7:
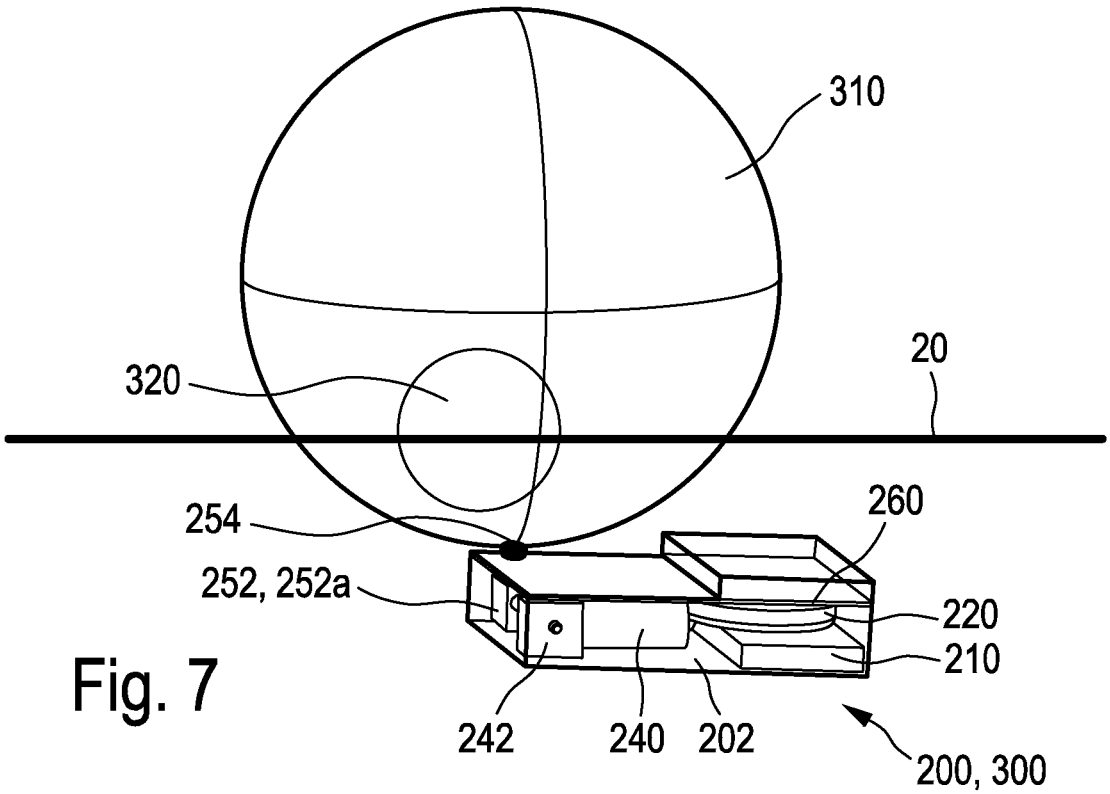
Figure 8:
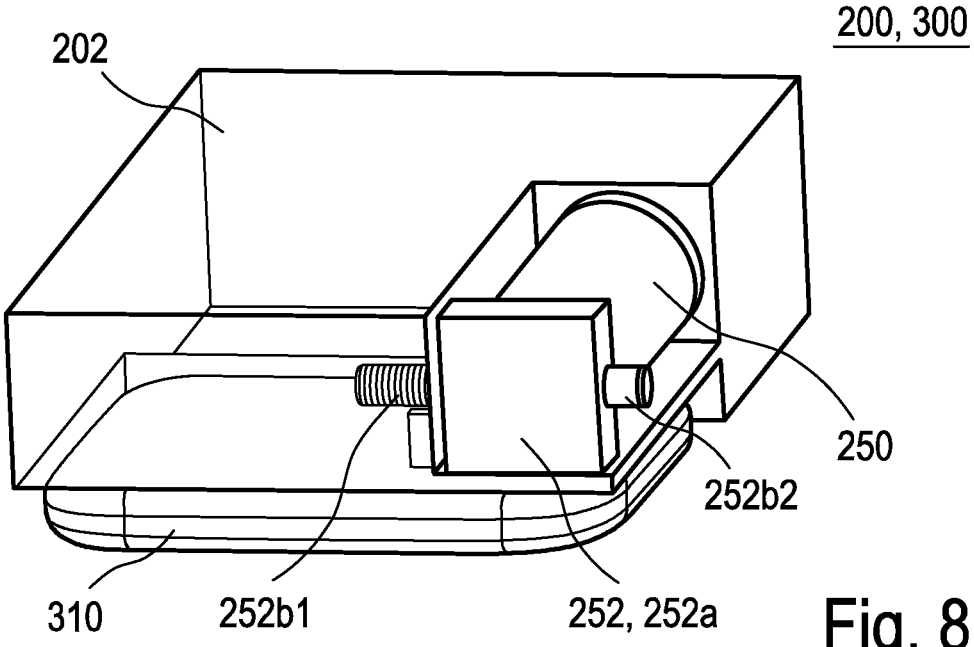
Figure 9:
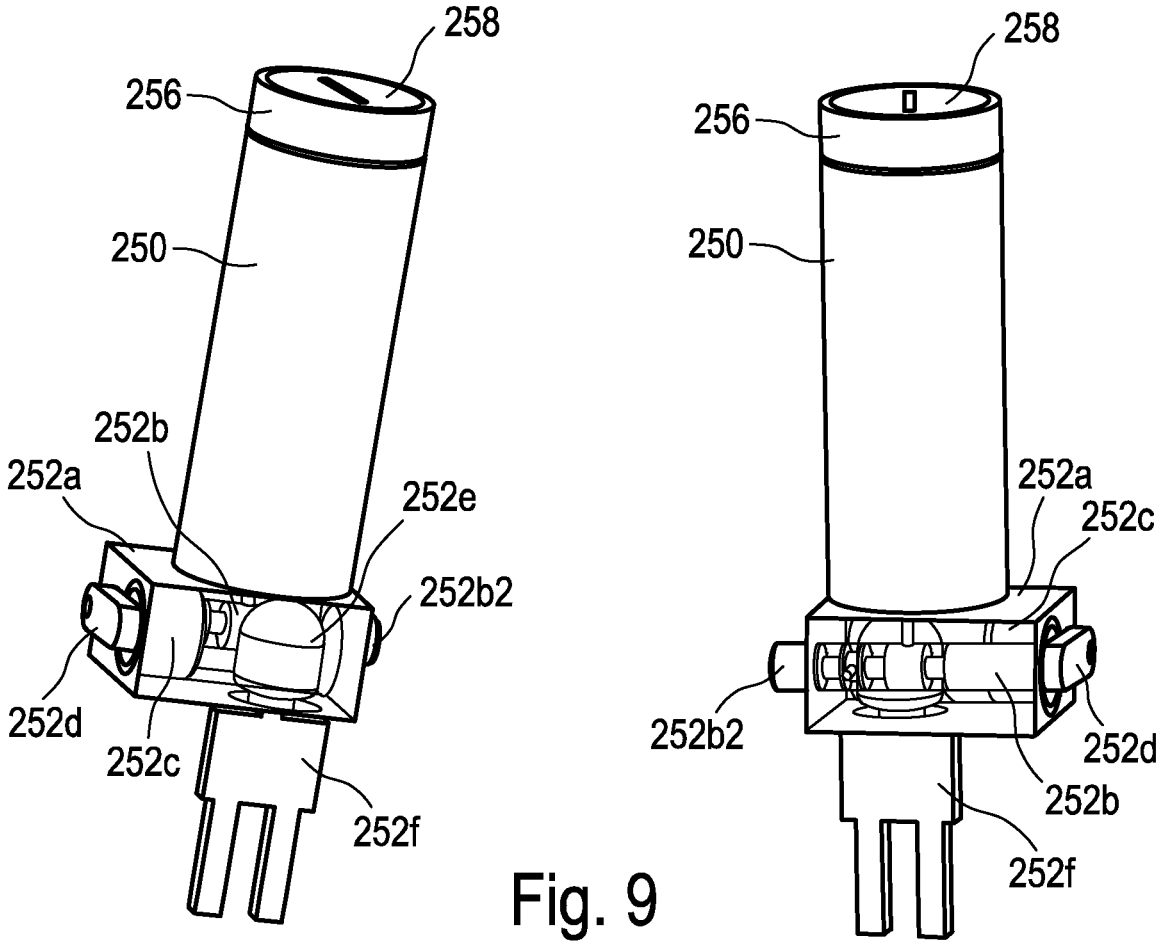
Figure 10:
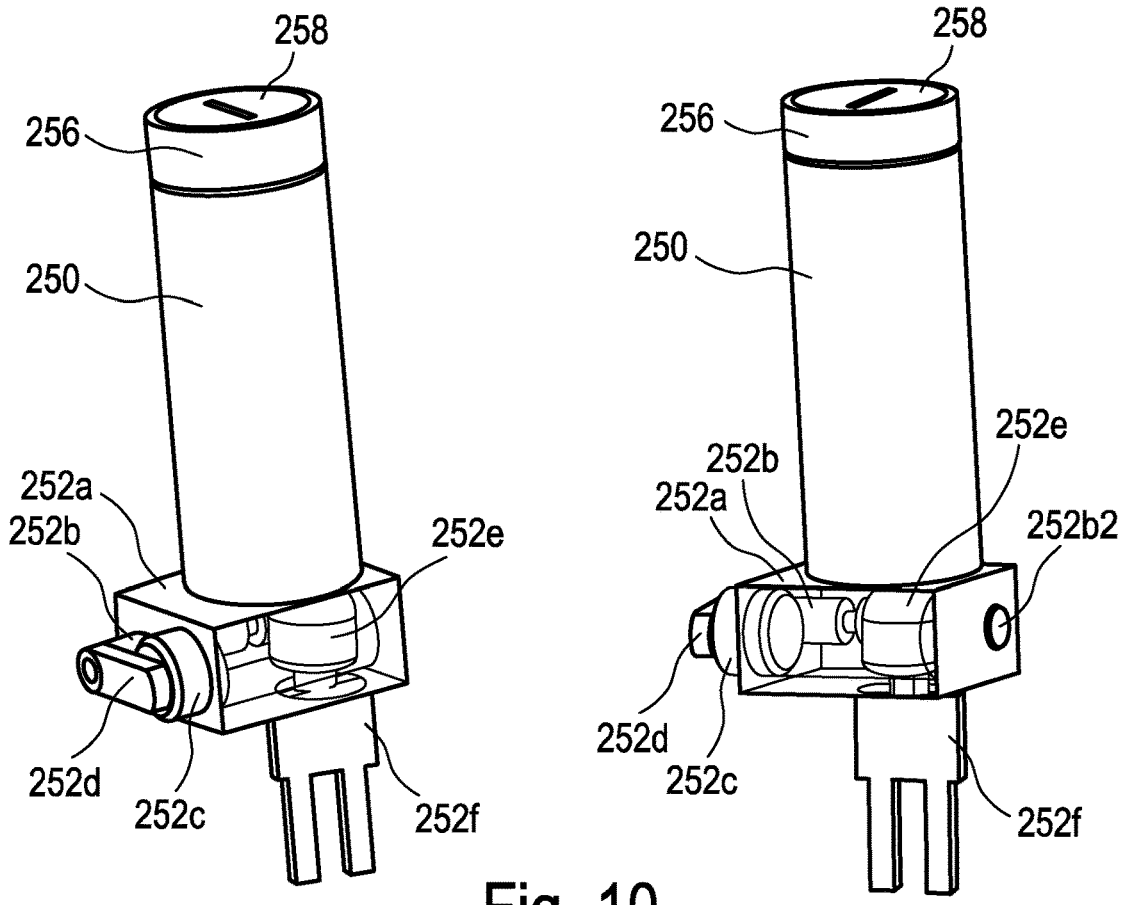
Figure 11:
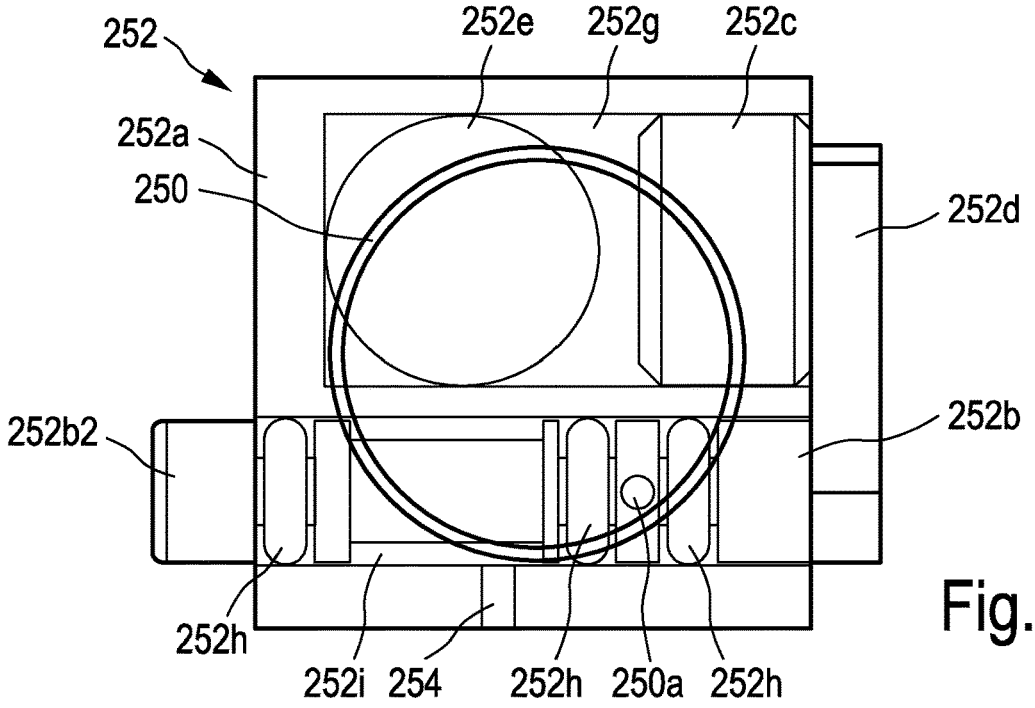
Figure 12:
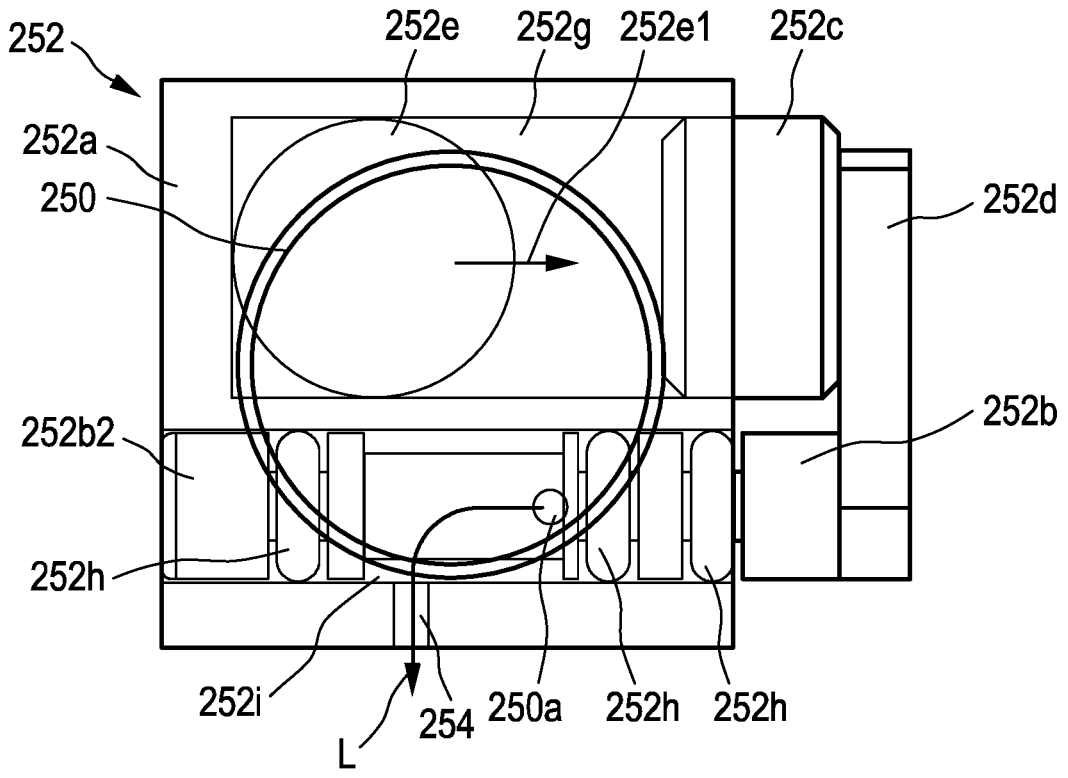
Figure 13A:
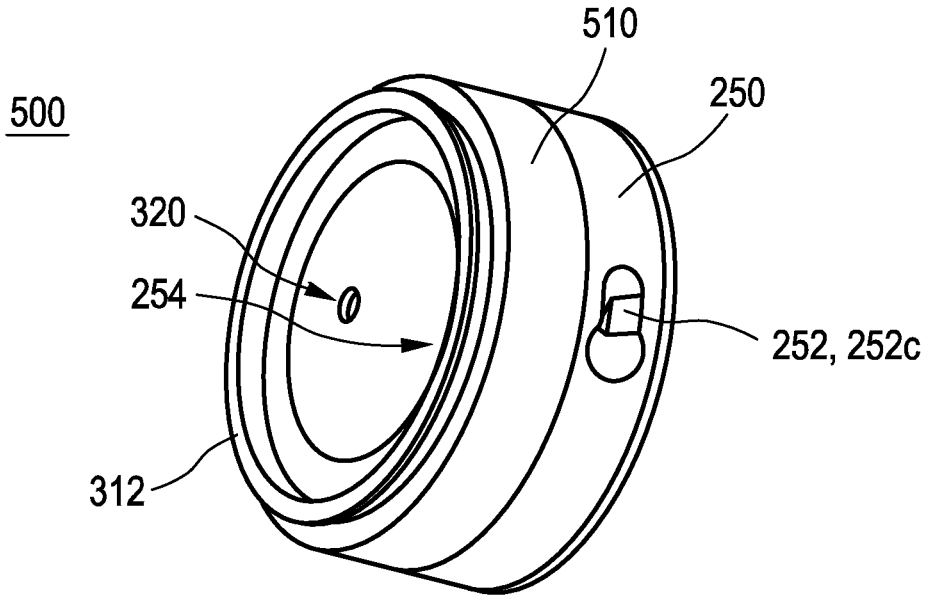
Figure 13B:
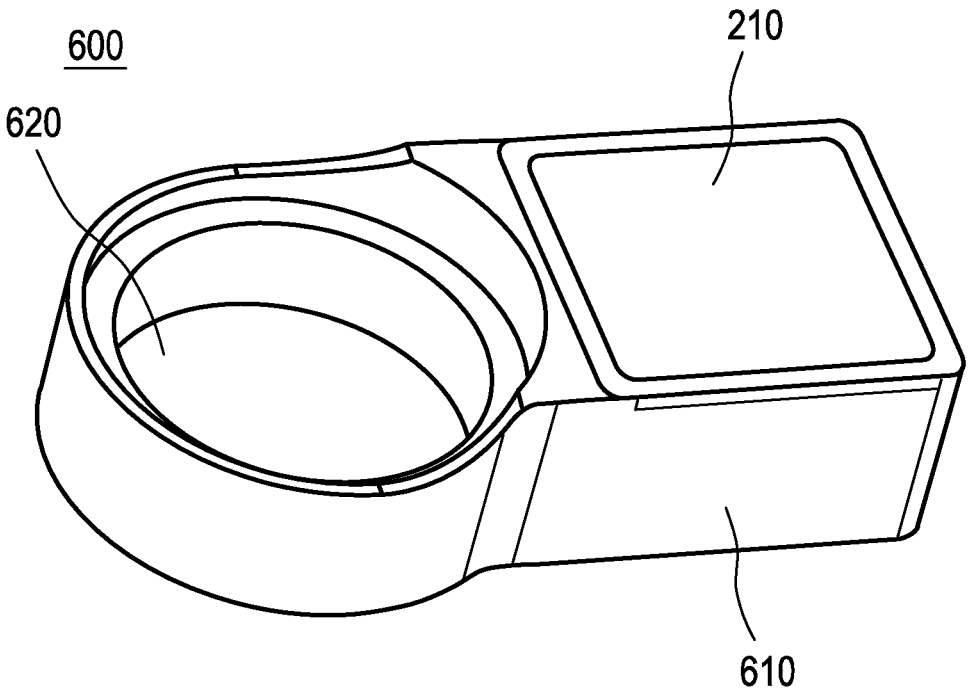
Figure 14:
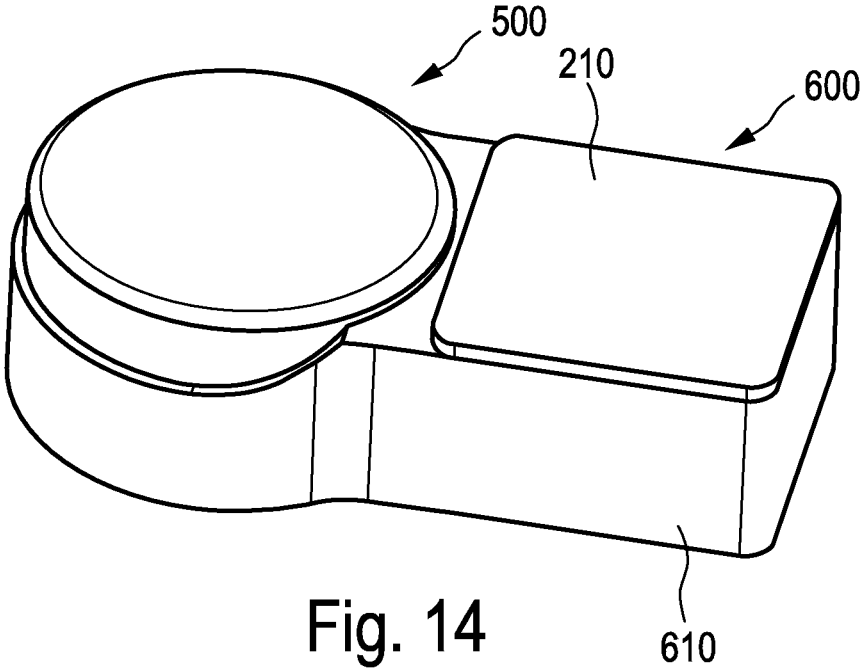
Figure 15:
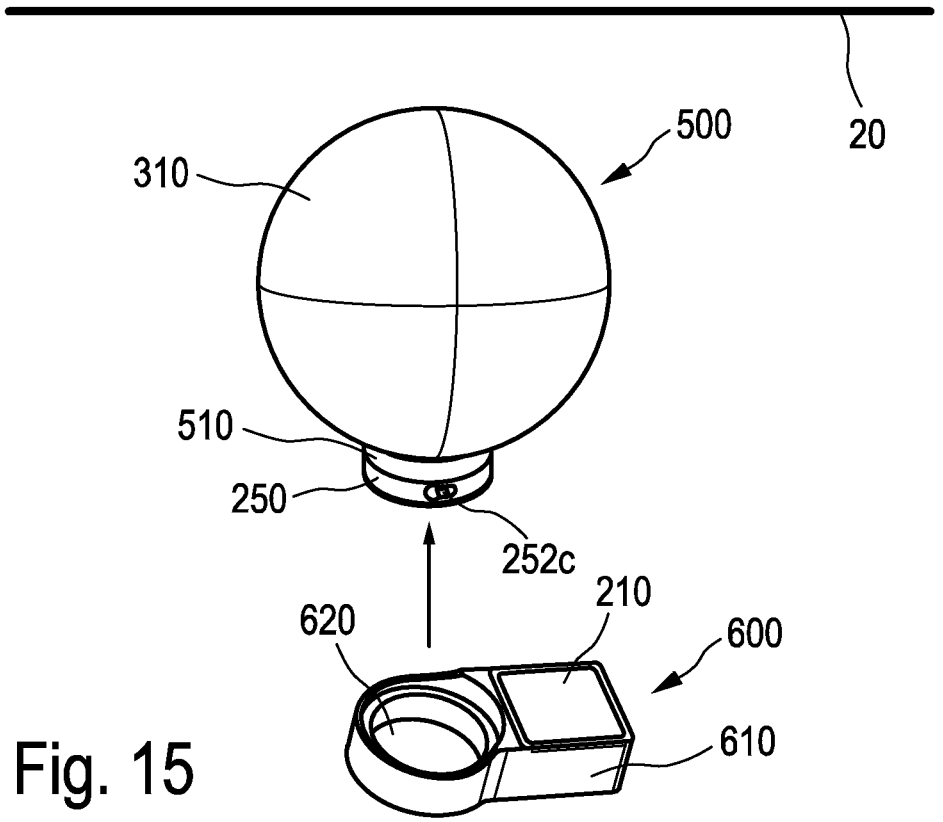
Figure 16:
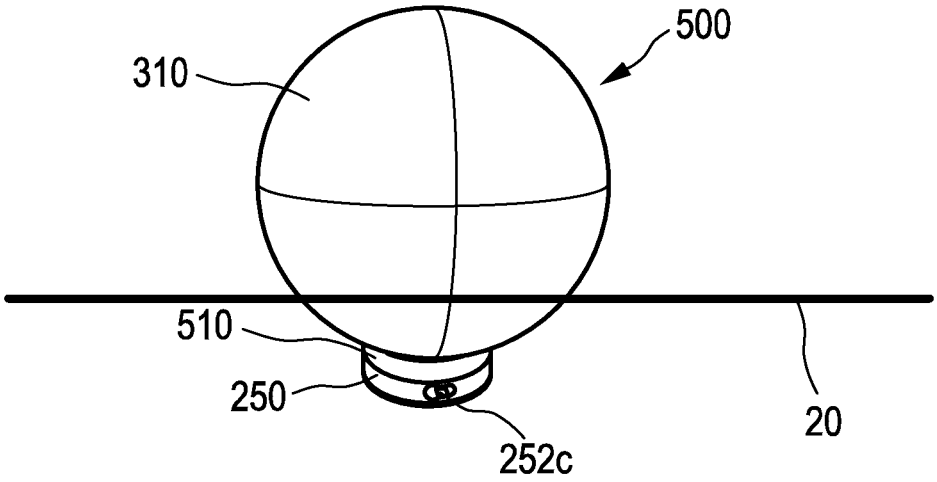
Figure 17:
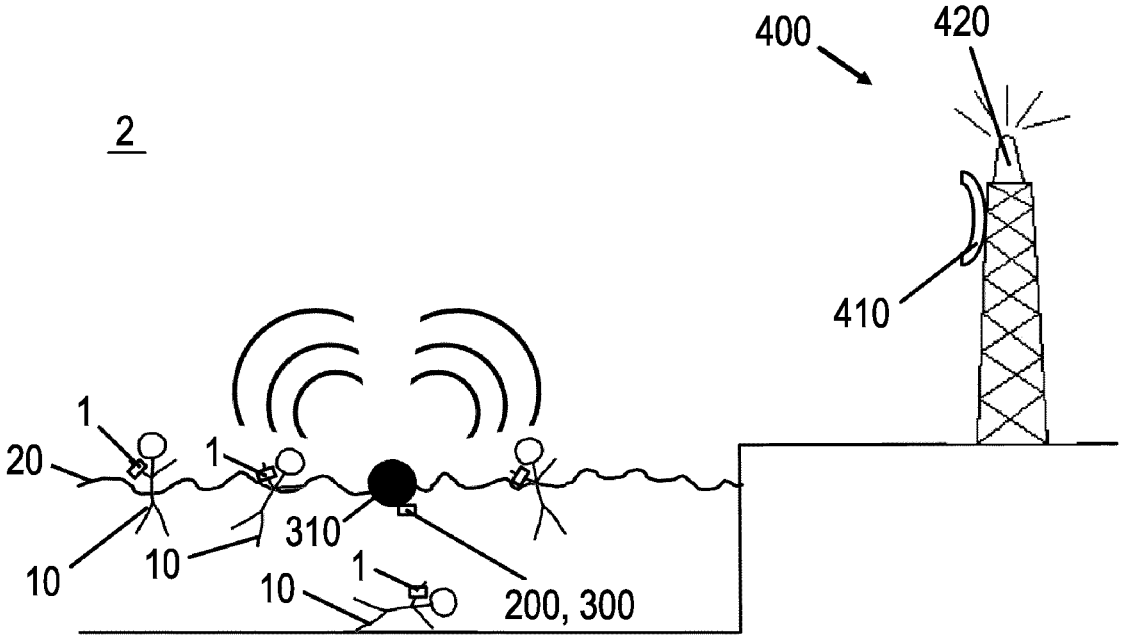
Figure 18:
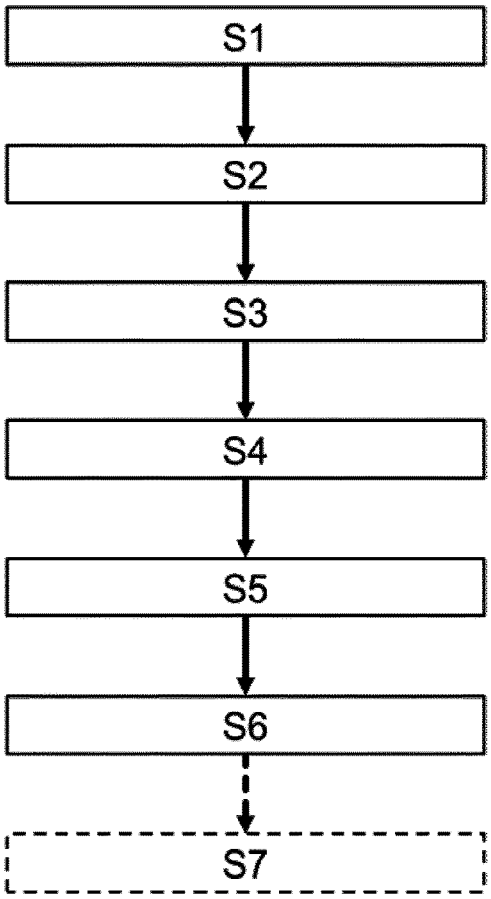
Figure 19:
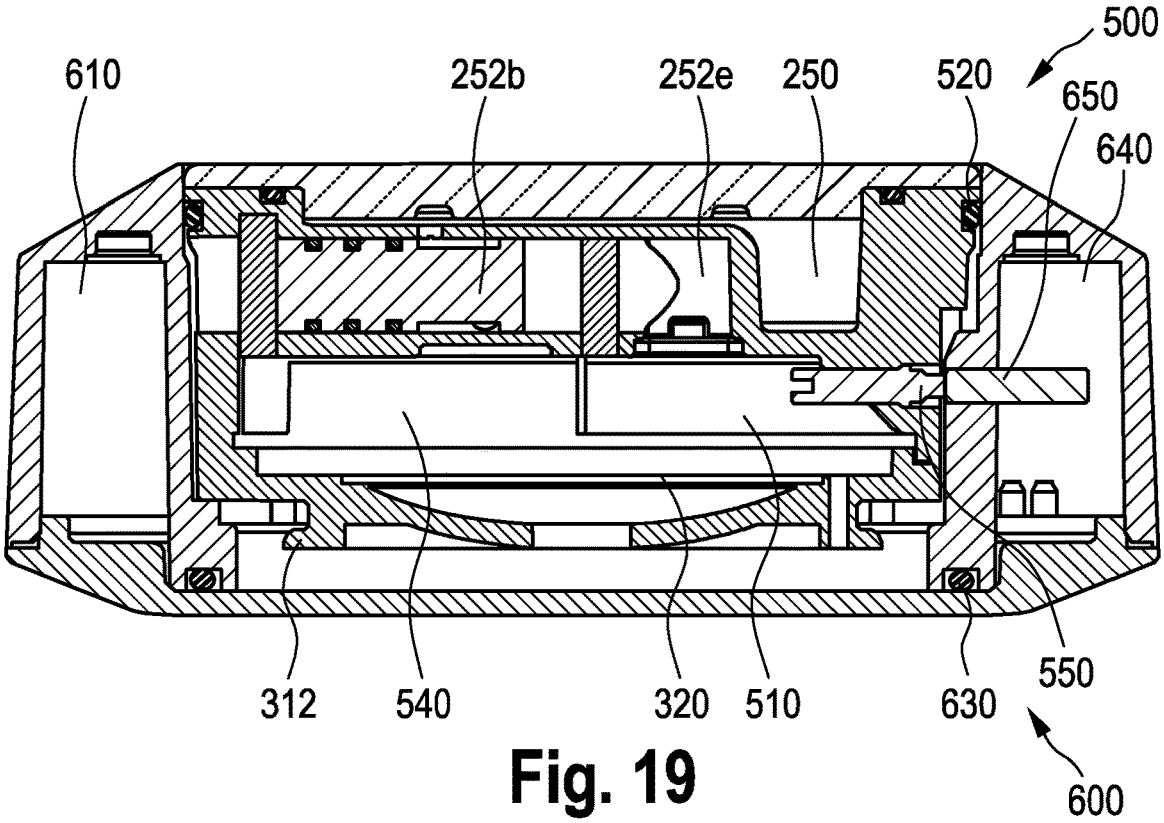
Figure 20:
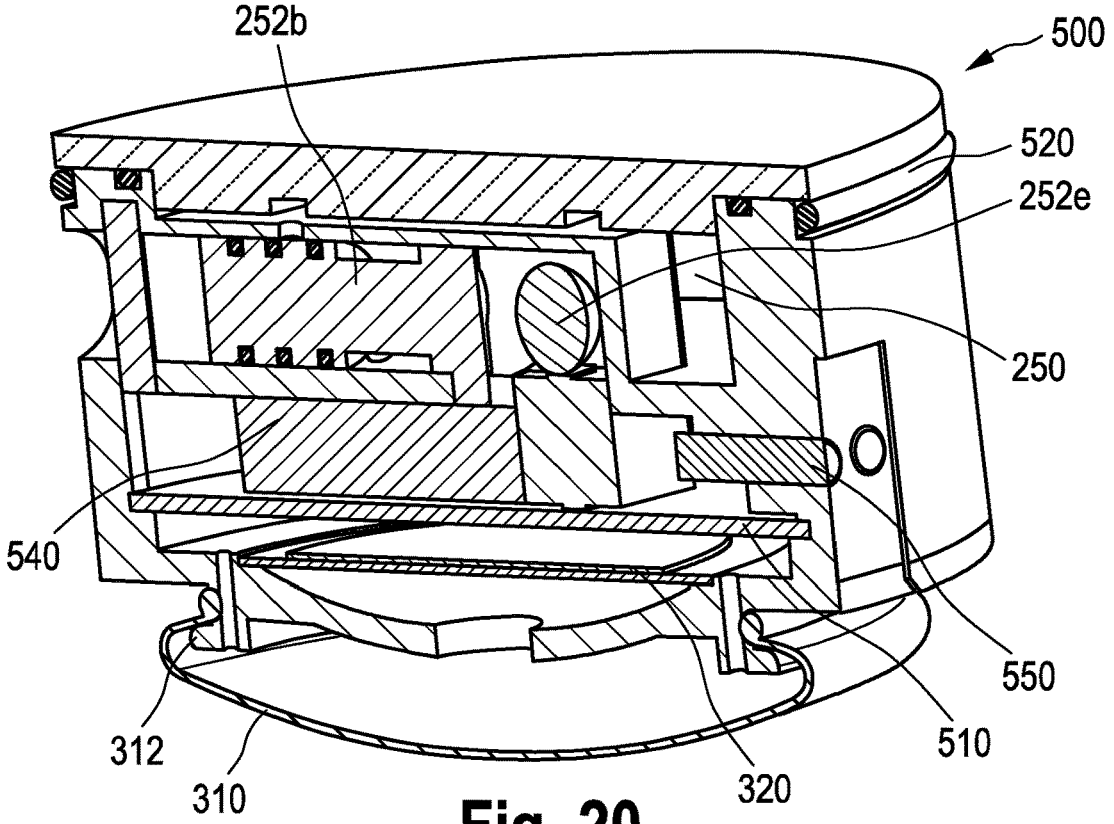
Figure 21:
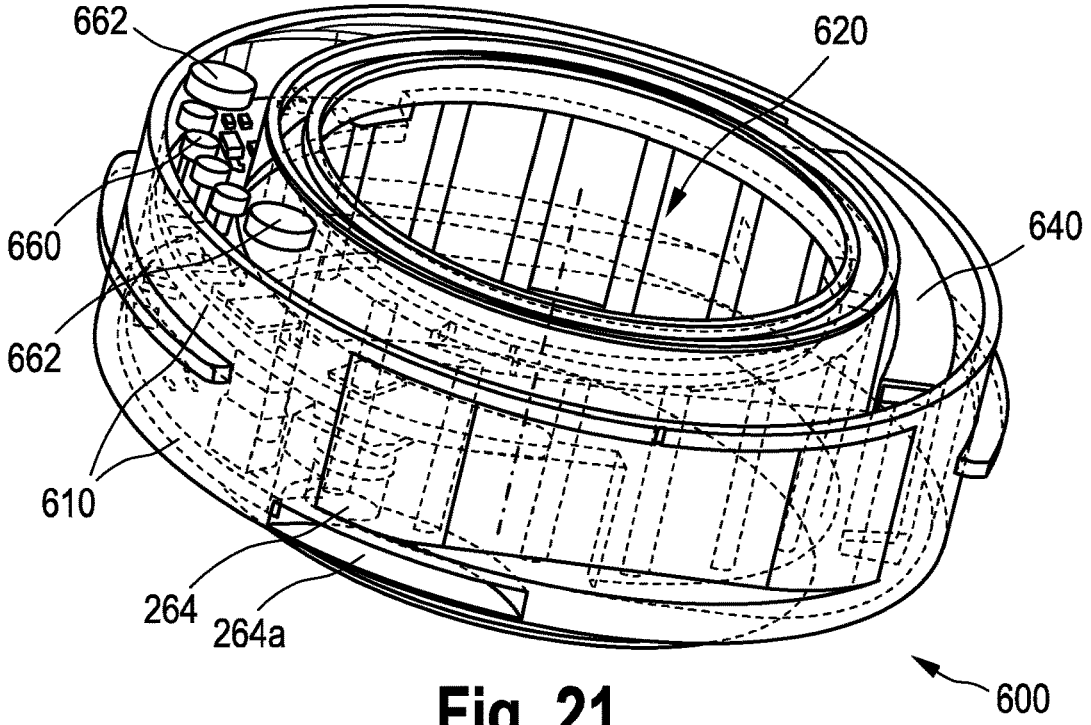
Figure 22:
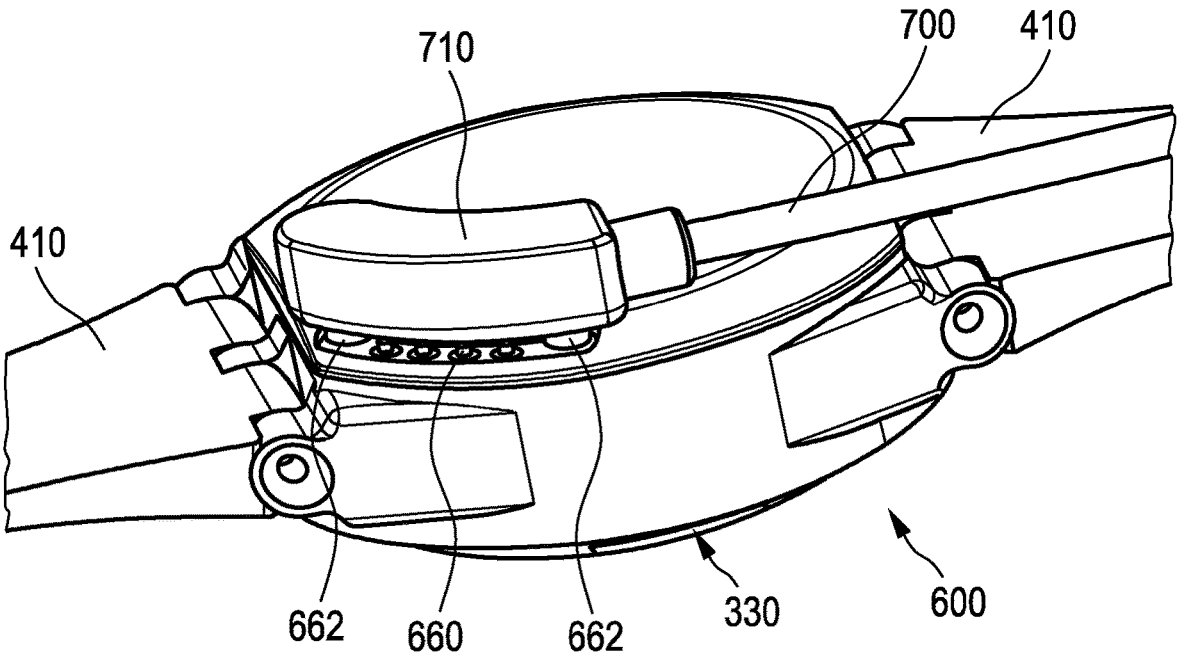
Figure 23:
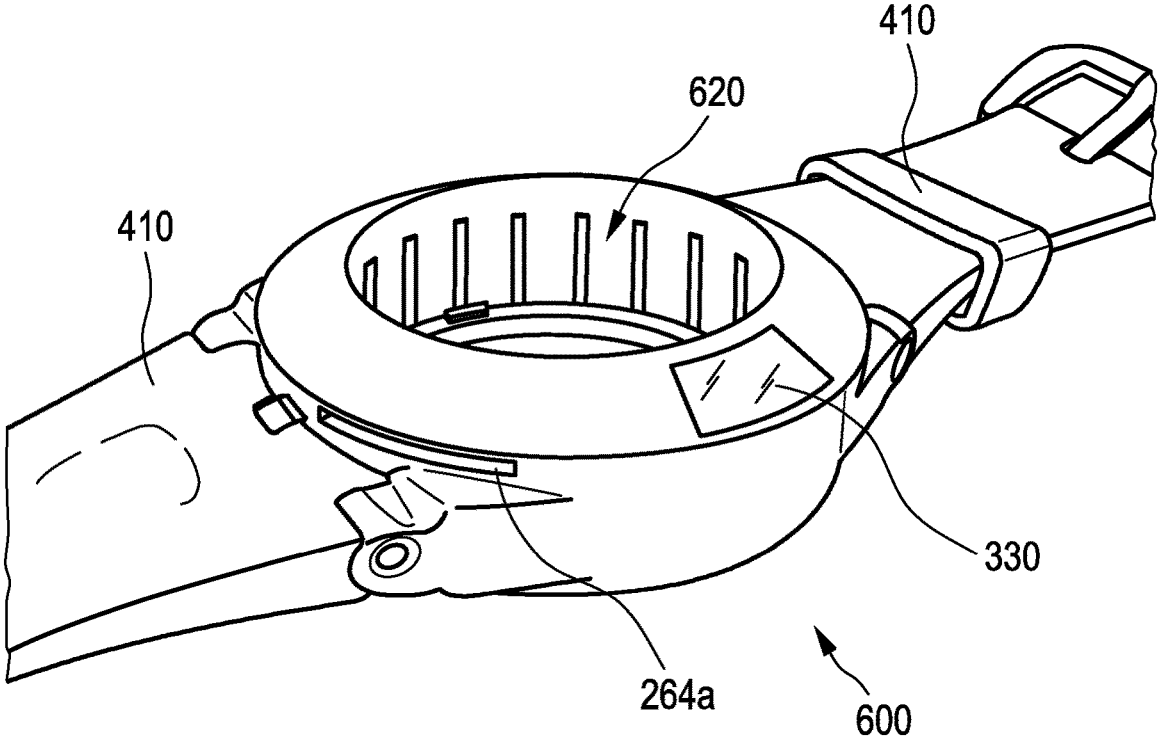

Additional advantageous further developments of the present invention are yielded by the subclaims and the following description of preferential implementations. Thereby shown are:

FIG. 1 a semi-transparent schematic three-dimensional view of an apparatus for monitoring persons in water according to one embodiment of the invention;

FIG. 2 a semi-transparent schematic three-dimensional view of a consolidated unit of monitoring device and signaling device of the apparatus according to FIG. 1;

FIG. 3*a* a semi-transparent schematic top view of the consolidated unit of monitoring device and signaling device according to FIG. 2 of the apparatus according to FIG. 1;

FIG. 3*b* a semi-transparent schematic side view of the consolidated unit of monitoring device and signaling device according to FIG. 2 of the apparatus according to FIG. 1;

FIG. 4 a schematic three-dimensional view of a motor and a pressure chamber with the elements connecting same of the apparatus according to FIG. 1;

FIG. 5 a schematic three-dimensional exploded view of the pressure chamber and a valve of the apparatus according to FIG. 1;

FIG. 6 a semi-transparent schematic three-dimensional view of an apparatus according to FIG. 1, wherein the consolidated unit of monitoring device and signaling device has detached from the carrier device (as in an emergency);

FIG. 7 a semi-transparent schematic three-dimensional view of the consolidated unit of monitoring device and signaling device of the apparatus according to FIG. 1, wherein the consolidated unit is situated at the surface of the water with the inflated flotation body;

FIG. 8 a semi-transparent schematic three-dimensional view of a consolidated unit of monitoring device and signaling device according to one variation of the first embodiment;

FIG. 9 a semi-transparent schematic three-dimensional view from two different perspectives of a pressure tank with a valve according to a second embodiment of the present invention in a pre-ignition state of a pyrotechnic device;

FIG. 10 a semi-transparent schematic three-dimensional view from two different perspectives of a pressure tank with a valve according FIG. 9 in a post-ignition state of the pyrotechnic device;

FIG. 11 a semi-transparent schematic view of a valve of the second embodiment according to FIG. 9 in a pre-ignition state of the pyrotechnic device;

FIG. 12 a semi-transparent schematic view of a valve of the second embodiment according to FIG. 9 in a post-ignition state of the pyrotechnic device;

FIG. 13*a* a schematic view of an alarm body as a first component of an inventive apparatus according to a further implementation;

FIG. 13*b* a schematic view of a base device as a second component of the inventive apparatus of the FIG. 13*a* implementation;

FIG. 14 a schematic view of an inventive apparatus according to the further implementation with the alarm body according to FIG. 13*a* and the base device according to FIG. 13*b* in the fixed state;

FIG. 15 a schematic view of the inventive apparatus according to FIG. 14 in the released state, wherein the alarm body is on the way to the water surface;

FIG. 16 a schematic view of the alarm body according to FIG. 13*a* situated with the inflated flotation body at the surface of the water;

FIG. 17 a schematic depiction of a system according to one implementation of the present invention as well as an example of use in a swimming pool;

FIG. 18 a schematic depiction of a method for the monitoring of persons in water according to one implementation of the present invention;

FIG. 19 a schematic cross-sectional view of an inventive apparatus according to the further implementation;

FIG. 20 a schematic three-dimensional partial cross-sectional view of an alarm body of the apparatus according to FIG. 19;

FIG. 21 a schematic semi-transparent three-dimensional view of a base device of the apparatus according to FIG. 19;

FIG. 22 a schematic three-dimensional view of the apparatus according to FIG. 19 with connected connecting cable; and FIG. 23 a schematic three-dimensional view of a base device of the apparatus according to FIG. 19.

FIGS. 1, 2, 4, 5 and 6 show schematic three-dimensional views of an apparatus for monitoring persons in water 1 (in the following: apparatus 1) or of components of same according to one embodiment of the invention. The apparatus 1 comprises a carrier device 100, a monitoring device 200 and a signaling device 300.

The apparatus 1 according to the implementation shown in FIG. 1 is designed to be worn on the arm, in particular on the wrist, of a person 10 to be monitored. To that end, the carrier device 100 comprises a wristband 110, of which only part is shown. The monitoring device 200 comprises a display 210, a battery 220, a motor 240, a pressure tank 250 and a plate 260. The signaling device 300 comprise a flotation body 310 and a ferroelectric vibrating body 320.

In the apparatus 1 according to the implementation of FIG. 1, the monitoring device 200 and the signaling device 300 are configured as a consolidated unit; i.e. in particular with a common plate 260 as a base and at least in part encapsulated together by means of a sealing compound 202 so as to be waterproof. This has the advantage that in case of emergency, no connections between the monitoring device 200 and the signaling device 300 need to be disengaged and the two devices 200, 300 can share a common power supply in the form of the battery 220. Not enclosed by the sealing compound 202 are in particular the flotation body 310 and the ferroelectric vibrating body 320 as well as a limit stop 252*b*2 and at least one part of a pressure sensor device 264.

The motor 240 comprises a drive 242 and an internal thread interface 244.

The pressure tank 250 comprises a valve 252 having a valve housing 252*a* and a valve pin 252*b*. The pressure tank 250 furthermore comprises a gas outlet 254, an—in particular welded—end piece 256, and a self-sealing fill screw 258. The pressure tank 250 is filled with air which is pressurized at 200 bar. The pressure tank 250 is rated to a maximum pressure of at least twice the pressure actually used. This thereby further increases the safety of the apparatus 1, in particular with respect to unwanted gas leakage. At its one end, the valve housing 252 is in gas-conducting connection with the pressure tank 250 and, at its other end, in gas-conducting connection with the flotation body 310 via the gas outlet 254. The valve pin 252*b* exhibits an external thread interface 252*b*1 and the limit stop 252*b*2.

The motor 240 is connected to the drive 242 in a force-transmitting or torque-transmitting manner. The drive 242 is thereby provided to redirect the direction of the torque generated by the motor 240 at an angle of substantially 90° and in particular to reduce the speed furnished by the motor 240.

The direction and/or speed-modified rotational motion is transferred to the internal thread interface 244 at the output end of the drive 242. The internal thread interface 244 is always engaged with the external thread interface of the valve pin 252*b*. The valve pin 252*b* is mounted in the valve housing such that the valve pin 252*b* is only allowed translational motion. The valve pin 252*b* is in particular prevented from rotating about its longitudinal axis by a tongue/groove connection. The rotational motion of the motor 240 produces a rotational movement of the internal thread interface 244, which is provided for the valve pin 252*b* to be translationally moved along its longitudinal axis. This ensues by the valve pin 252*b* being moved in valve housing 252*a* via the engaged threaded teeth, similar to a standard vice where rotation at a nut limited in its degrees of freedom likewise induces an operation of the movable retaining jaws.

The valve pin 252*b* fulfills two tasks in the described implementation: on the one hand, its original task, i.e. closing/opening the valve 252 and, on the other, blocking/releasing the consolidated unit detachably connected to the carrier device 100. To that end, the limit stop 252*b* of the valve pin 252 engages in a recess of the carrier device 100 and thus fixes, in particular positively, the consolidated unit on the carrier device 100.

In the initial situation (i.e. no danger detected), the valve pin 252*b* closes off the pressure tank 250 and the one end of the valve pin serving as limit stop 252*b*2 pushes into the recess in the carrier device 100, whereby the consolidated unit 200, 300 is fixed to the carrier device 100. Upon an emergency, the motor 240 displaces the valve pin 252*b* in the manner described above, wherein the one end of the valve pin serving as limit stop 252*b*2 is pulled out of the recess in the carrier device 100, whereby the consolidated unit detaches from the carrier device 100. At the same time as the release or after a delay, the valve pin 252*b* enables the gas-conducting connection between the pressure tank 250 and the flotation body 310.

Due to Le Chatelier's principle, the air in the pressure tank 250 expands into the flotation body 310, in particular a latex balloon, which exhibits a diameter of 5 to 15 cm and a signal color. The flotation body fills and draws the consolidated unit non-detachably connected to the flotation body via the gas outlet upward toward the surface of the water.

After the emergency being detected, although at the latest subsequent to reaching the water surface, the consolidated unit, in particular the ferroelectric vibrating body 320, begins to emit an audio signal at a frequency in the range of 2 kHz to 10 kHz and at a volume of approximately 100 decibels.

The display 210 shows information relating to the set limit values for maximum depth and maximum duration as well as information on the state of charge of the battery 220 and the readiness of apparatus 1, in particular by a direct or indirect display of the internal pressure in the pressure tank 250. The display 210 additionally serves in showing further information such as for example the account balance of a cashless payment system or the locker number or remaining swim time.

FIGS. 3*a* and 3*b* show a semi-transparent schematic top/side view of the consolidated unit of monitoring device and signaling device according to FIG. 2.

Arranged on the plate 260 are the display 210, the battery 220, the motor 240 with drive 242 and internal thread interface 244, the pressure tank 250 with valve 252 comprising the valve housing 252*a* and valve pin 252*b*, the gas outlet 254, various electrical and/or electronic components 262, in particular a central processing unit (CPU), the pressure sensor device 264, the flotation body 310, the ferroelectric vibrating body 320 and the connecting cables 322 of the ferroelectric vibrating body 320.

A commercially available button cell is used as battery 220. The ferroelectric vibrating body 320 is electrically connected to the signaling device 300 and/or the monitoring device 200 by the connecting cables 322.

The ferroelectric vibrating body 320 is thereby arranged inside the flotation body 310 so as to be able to use it as a resonating body during an emergency.

It is particularly evident from FIGS. 3*a* and 3*b* how the sealing compound 202 extends around the consolidated unit. Not enclosed by the sealing compound 202 are in particular the flotation body 310 and the ferroelectric vibrating body 320 as well as the limit stop 252*b*2 and at least one part of a pressure sensor device 264, in particular the sensor element.

FIG. 7 shows a semi-transparent schematic three-dimensional view of the consolidated unit 200, 300 of monitoring device 200 and signaling device 300 of the apparatus 1 according to FIG. 1, whereby the consolidated unit 200, 300 is situated at the water surface 20 with the inflated flotation body 310. The flotation body 310 is dimensioned such that it is capable of conveying the signaling device 300 and the monitoring device 200 to the water surface 20 and keeping it there, particularly in a way so as to hold a part of the flotation body 310 there, in particular more than 50% of the flotation body 310, which is in a signal color, in particular red. As soon as the consolidated unit 200, 300 has detached from the carrier device 100 or while the consolidated unit 200, 300 is on its way to the water surface 20 or is at the water surface 20, the signaling device 300 begins to emit an acoustic signal at a frequency of 4 kHz and a volume of 100 decibels via the ferroelectric vibrating body 320 which uses the flotation body 310 as a resonating body and is powered by the battery 220. This acoustic signal is supported in terms of localizing the swimmer in distress by the flotation body 310 of one or more signal colors being held at the water surface 20.

FIG. 8 shows a variation of the above-described first embodiment of the consolidated unit as was described in relation to the embodiment of FIGS. 1, 2, 4, 5 and 6. All of the above remarks also apply equally to this variation of the first embodiment unless stated otherwise in the following remarks.

The consolidated unit of FIG. 8 differs from the consolidated unit of FIGS. 1, 2, 4, 5 and 6 described above by additionally the pressure tank 250, the valve housing 252*a* and parts of the valve pin 252*b* not being enclosed by the sealing compound 202. This has the advantage that in the unwanted case of gas escaping from the pressure tank 250, in particular in the form of a leak, the escaping gas does not flow into the sealing compound 202 and damage it but is rather released to the environment without further damage to the apparatus 1. This implementation is furthermore advantageous as the pressure tank 250 is more easily accessible in the event of a scheduled or unscheduled inspection.

The consolidated unit is preferentially covered by a protective cover (not shown) in the non-emergency state.

The motor 240 can alternatively also be aligned flush to the valve pin 252*b* so that a drive 242 can be dispensed with.

Instead of the motor 240 with the drive 242 and the internal thread interface 244 and external thread interface 252*b*1, a linear drive, in particular a step motor, can also be provided which is directly connected in force-transmitting manner to the valve pin 252*b* in order to move same.

FIGS. 9, 10, 11 and 12 show semi-transparent schematic three-dimensional views from different perspectives of a pressure tank 250 having a valve 252 according to a second embodiment of the present invention in a state prior to (FIGS. 9 and 11) or subsequent to (FIGS. 10 and 12) the tripping of a pyrotechnic device 252*e*. All of the above remarks related to the first embodiment also apply equally to the second embodiment unless stated otherwise in the following remarks.

The second embodiment of the present invention differs from the first embodiment substantially by the fact that the movement of the valve pin 252*b* is not initiated by a motor 240 but rather by a pyrotechnic device 252*e*. Thus, in the second embodiment, the components of motor 240, drive 242, internal thread interface 244 as well as external thread interface 252*b*1 of the valve pin 252*b* are eliminated.

The pyrotechnic device 252*e* is arranged within the valve housing 252*a* in a first pressure channel 252*g*, wherein the valve housing 252*a* is preferentially substantially gas-tight, in particular gas-tight with respect to air at a pressure of up to 1000 bar.

The pyrotechnic device 252*e* is electrically connected to the monitoring device 200, in particular to the battery 220, via a contact device 252*f*.

The pyrotechnic device 252*e* is furthermore in gas-conducting connection with an actuator device 252*c*, in particular in the form of a piston containing Teflon, via the first pressure channel 252*g* such that the gas developing upon the pyrotechnic device 252*e* being ignited exerts a force on the actuator device 252*c* in propagation direction 252*e*1 sufficient enough to displace the actuator device 252*c* in at least one predefined direction of movement, in particular a longitudinal axis of the actuator device 252*c*.

The actuator device 252*c* is furthermore connected to the valve pin 252*b* via a force transmission device 252*d*. The longitudinal axis of the valve pin 252*b* and the Teflon-comprising piston 252*c* are thereby aligned at least substantially parallel, particularly parallel, to each other. The force transmission device 252*d* is disposed outside the valve housing 252*a* and connects the valve pin 252*b* to the actuator device 252*c* in such a way that motion of the actuator device 252*c* is transmitted axially, in particular in the direction from the valve housing 252*a* to the valve pin 252*a* so that it its motion is at least substantially identical, in particular identical to the actuator device 252*c*.

In the pre-ignition state of the pyrotechnic device 252*e* (FIGS. 9 and 11), the actuator device 252*c* is at least substantially fully, in particular fully countersunk into the valve housing 252*a*.

Analogously to the first embodiment, in the initial situation (i.e. no danger detected), the valve pin 252*b* closes off the pressure tank 250 and the one end of the valve pin 252*b* serving as limit stop 252*b*2 pushes into the recess in the carrier device 100 (not shown in FIGS. 9 to 12), whereby the consolidated unit 200, 300 is fixed to the carrier device 100. Upon an emergency (see FIGS. 10 and 12), the valve pin 252*b* is displaced as described below, wherein the one end of the valve pin 252*b* serving as limit stop 252*b*2 is pulled out of the recess in the carrier device 100, whereby the consolidated unit detaches from the carrier device 100. At the same time as this release or after a delay, the valve pin 252*b* enables the gas-conducting connection between the pressure tank 250 and the flotation body 310.

Upon an emergency, energy is transmitted from the battery 220 to the pyrotechnic device 252*e* via the monitoring device 200. Same preferentially being an energy pulse at a voltage of 12 Volt. The energy pulse ignites the pyrotechnic device 252*e*; i.e. a component of the pyrotechnic device 252*e* and/or a substance of the pyrotechnic device 252*e*, or burns off within the pyrotechnic device 252*e*. A gas thereby develops which collects in the valve housing 252*a* and thus builds up a pressure which acts on the actuator device 252*c*. The actuator device 252*c* is at least partly forced out of the valve housing 252*a* due to the pressure building up inside the valve housing 252*a*. The actuator device 252*c* is connected to the valve pin 252*b* via the force transmission device 252*d* as previously described above in such a way that the movement of the actuator device 252*c* is transmitted to the valve pin 252*a*, whereby the latter is likewise displaced laterally along its longitudinal axis. The one end of the valve pin 252*b* serving as limit stop 252*b*2 is thereby pulled out of the recess in the carrier device 100, whereby the consolidated unit detaches from the carrier device 100. At the same time as the release or after a delay, the valve pin 252*b* enables the gas-conducting connection L between the pressure tank 250 and the gas outlet 254 to the flotation body 310 via the outlet of the pressure tank 250*a*.

FIGS. 13*a*, 13*b*, 14, 15 and 16 show a further embodiment of the inventive apparatus. This further embodiment particularly differs from at least some of those preceding in that a consolidated unit of monitoring device 200 and signaling device 300 does not separate from a carrier device 100 upon an emergency but rather individual components of the monitoring device 200 remain in the carrier device 100 upon an emergency while other components of the monitoring device 200 rise to the water surface 20 together with the signaling device 300. All of the above implementations, in particular as to the embodiment and operating principle of the individual components, also apply equally to this further embodiment unless stated otherwise in the following remarks and/or relevant figures.

The signaling device 300 forms an alarm body 500 together with the components of the monitoring device 200 described below which rise to the water surface 20 in the event of an emergency together with the signaling device 300.

The carrier device 100 forms a base device 600 together with the components of the monitoring device 200 described below which remain in the carrier device 100 upon an emergency.

FIG. 13*a* shows a schematic view of the alarm body 500, albeit without the flotation body 310 (not shown). The alarm body 500 comprises: the pressure tank 250, the valve 252, in particular comprising the pyrotechnic device 252*e*, the flotation body 310, a flotation body mount 312 for fixing the flotation body 310, the ferroelectric vibrating body 320 and alarm body electronics 510. The alarm body electronics 510 comprise: part of a plug-socket system (not shown) for electrically connecting the alarm body 500 to the base device 600 exhibiting the complementary part of the plug-socket system (not shown). Furthermore, the alarm body electronics 510 has an independent power supply in the form of battery 220, in particular in the form of a button cell. Additionally to the ferroelectric vibrating body 320, the alarm body 500 can furthermore comprise optoelectrical components (not shown), in particular light emitting diodes, according to one preferential implementation in order to visually enhance the effect of the audio signal generated in an emergency by the ferroelectric vibrating body, in particular in the form of a beacon, particularly a flashing signal, preferentially in the form of a flash-like signal generated at intervals.

The valve 252 is integrated into the pressure tank 250 in the implementation of FIG. 13*a* for the purpose of optimized space utilization. The mode of action of valve 252 corresponds to the above remarks on the other embodiments. Even if the preferential variant of the pyrotechnic valve actuation is shown in FIG. 13*a*, it is of course also possible to realize the above-described motor valve actuation in the alarm body 500. The gas released through the valve 252 in an emergency flows through the gas outlet 254 (not shown), which is arranged for example in the proximity of the inner edge of the flotation body mount 312, into the flotation body 310 and inflates it.

In the implementation of FIG. 13*a*, the ferroelectric vibrating body 320 is arranged behind the opening indicated by arrow 320, in particular on a plate of the alarm body electronics 510.

The alarm body electronics 510 is provided, in particular configured, to open the valve 252 upon a signal of the base device 600 so that the flotation body 310 unfurls and the alarm body 500 detaches from the base device 600 as described in detail below, rises to the water surface 20, and draws attention there to the emergency by means of an audio signal, in particular supported in its effect by an optical signal.

The energy to actuate the valve 252, in particular to ignite the pyrotechnic device 252*e*, can thereby be provided by the battery 220 of the alarm body, or by an energy storage (not shown) of the base device 600, as described in detail below.

In the absence of an emergency, the alarm body 500 is fixed via limit stop 252*b*2 (not shown in FIG. 13*a*) in the manner as described above for the other embodiments using a recess (not shown) on the base unit 600 (see FIG. 14). Upon an emergency, the valve pin 252*b* is displaced in the above-described manner, wherein the one end of the valve pin, which serves as limit stop 252*b*2, is pulled out of the recess in the base device 600, whereby the alarm body 500 detaches from the base device 600.

The base device 600 is shown in FIG. 13*b*. The base device 600 is provided for wearing on the arm, in particular on the wrist, of a person to be monitored by means of a wristband (not shown), comparably to a watch. Of course it is likewise possible to accordingly affix the base device to other parts of the body of the person 10 to be monitored, in particular a leg, the neck, the head or the like.

The base device 600 has a power supply independent of the alarm body 500, in particular a battery, preferentially a rechargeable battery (not shown). Moreover, the base device 600 comprises a wired, in particular cable-connected, and/or wireless, in particular radio-based, such as e.g. WLAN, Bluetooth etc., and/or light-based, in particular infrared-based, interface for communicating with an external data processor device such as for example a PC, a smartphone or the like. Data can be read out from the apparatus via this interface and/or it can be configured in the above-described manner, in particular using an apparatus-specific program installed on the data processor device.

The base device 600 further comprises the display 210 and base device electronics 610. The base device electronics 610 comprises at least the following of the above-described components which are configured and function comparably here: the processor device, which is provided to fulfill at least some of the processor device functions described above in the context of the other embodiments provided they are not undertaken by the alarm body electronics 510; and the sensor device 264, in particular the pressure sensor device.

Evaluation of the at least one sensor device 264 ensues via the processor device of the base device 600. Should same conclude there is an emergency, it issues a signal to the alarm body 500, whereupon the latter disengages from the base device 600 in the manner as described above.

The base device 600 furthermore comprises an alarm body support 620 which is provided to hold at least part of the alarm body 500 therein, or thereon respectively as per one not-shown embodiment, in the absence of an emergency.

In the absence of an emergency, the base device 600 is electrically connected to the alarm body 500. In so doing, the alarm body electronics 510 can in particular be supplied via the power supply of the base device 600 in the absence of an emergency in order to preserve the in particular at least substantially non-rechargeable battery 220 in this implementation. In so doing, the state of charge of the battery 220 of the alarm body 500 can also be monitored and e.g. communicated via the display 210. If necessary, the power supply of the base device 600 can be used to maintain the voltage of the battery 220, in particular to charge same when needed.

FIGS. 15 and 16 show the alarm body 500 during an emergency, wherein the alarm body 500 is still in the ascent phase to the water surface 20 in FIG. 15 whereas it has already reached the water surface 20 in FIG. 16.

Unless stated otherwise in the above remarks and/or figures, the above remarks on the detaching, the rising to the water surface and the behavior of the consolidated unit at the water surface can carry over in an at least substantially identical manner to the embodiment with alarm body and base device.

FIG. 17 shows a schematic depiction of a system according to one implementation of the present invention as well as an example of use in a swimming pool. Each person 10 to be monitored wears an apparatus 1 on their wrist. At least one base station 400, comprising a receiver device 410 and a transmitter device 420, is arranged in such a way relative the swimming pool that the receiver device 410 is able to receive a signal from the apparatus 1, in particular the signaling device 300.

The signaling device 300 of the apparatus 1 of the person 10 at the bottom of the pool emits an audio signal so as to make the other people 10 in the pool or persons in the vicinity of the pool (not shown) aware of the emergency. The base station 400 detects the audio signal by means of its receiver device 410 and emits a distress call also to more distant locations such as e.g. rescue and/or water rescue services and/or fire departments and/or police stations and/or medical emergency services by means of its transmitter device. Additionally, the transmitter device 420 can generate a further audio and/or visual signal to draw the attention of even more distant persons, e.g. at the edge of the pool, to the emergency.

FIG. 18 shows a schematic representation of a method for monitoring persons in water according to one implementation of the present invention, comprising the steps, in particular in the following order:

- S1 fastening an apparatus for the monitoring of persons in water of the type described above in different implementations onto a person;
- S2 the sensor device detecting whether, in particular how deep, the person is in the water;
- S3 a time-measuring device of the monitoring device detecting how long the person remains in the water, in particular below a predefined depth;
- S4 an emergency being determined as soon as the person remains in the water for longer than a predefined length of time, particularly below a predefined depth, in particular continuously;
- S5 the signaling device at least partly, particularly completely, detaching from the carrier device upon a signal of the monitoring device;
- S6 the signaling device rising to the surface of the water.

As an optional step, as indicated by the dotted lines in FIG. 18, the method furthermore comprises the step:

- S7 the signaling device emitting an audio signal and/or a visual signal and/or a radio signal.

FIGS. 19 to 23 show a further implementation of an inventive apparatus for monitoring persons in water 1 exhibiting the alarm body 500 and the base device 600.

In FIG. 19, the alarm body 500 is connected to the base device 600, in particular inserted into the alarm body support 620 of the base device 600, whereby the flotation body 310 is not depicted.

The alarm body 500 of FIGS. 19 and 20 comprises the pressure tank 250 which is formed by a recess inside the alarm body 500 and particularly furthermore limited by a cover of the alarm body 500. The valve pin 252*b* in FIG. 19 has enabled a gas passage between the pressure tank 250 and the flotation body 310, whereas the valve pin 252*b* blocks this gas passage in FIG. 20. The movement of the valve pin from the closed position (FIG. 20) to the open position (FIG. 19) is preferentially of non-destructive reversible design. The movement of the valve pin 252*b* is triggered in the depicted implementation by a pyrotechnic device 252*e* which is ignited upon an emergency from a signal of the alarm body electronics 510. The gas released by the ignition produces a force on the valve pin 252*b* and moves it from the closed position into the open position. Ignition ensues by way of a signal of the alarm body electronics 510 which, in the inserted state, is connected to the base device electronics 610 in signal-carrying and/or energy-conducting manner via electrical contacts 550, 650. The electrical contacts 550, 650 are preferentially designed such that they separate from one another upon an emergency, in particular when the alarm body 500 detaches from the base device 600.

According to the implementation of FIGS. 19 to 23, the sensor device 264, in particular in the form of a pressure sensor device, is arranged in the base device 600. The measurement data is either transmitted to the alarm body 500 and the monitoring of the depth, in particular along with the time, ensues via the alarm body electronics 510, or the measurement data is monitored by the base device electronics and upon an emergency, a control signal is transmitted to the alarm body electronics 510 which in turn triggers an igniting of the pyrotechnic device 252*e*.

The alarm body 500 is supplied with energy, particularly during an emergency after separating from the base device 600, by its own battery 540.

The base device 500 is supplied with energy, particularly during an emergency after the alarm body 500 has separated, by its own battery 640.

The alarm body 500 is configured to separate from the base device 600 in an emergency in that as the flotation body 310 is being conveyed into the buoyant state as it inflates, an enlarging volume of the flotation body 310 is utilized to produce a force against part of the base device 600, in particular a base plate, wherein the force induces a separation of the alarm body 500 from the base device 600.

The flotation body 310 is held to the alarm body 500 by a flotation body mount 312. The ferroelectric vibrating body 320 is connected in gas-conducting manner to an interior space of the flotation body 310. In so doing, the sound produced via the ferromagnetic vibrating body 320 is at least partially emitted above the surface of the water over the flotation body 310.

In the inserted state, the alarm body 500 is sealed vis-à-vis the base device 600 by a sealing device 520, in particular a sealing ring. Individual components or component assemblies of the base device 600 can likewise be sealed relative each other by means of a sealing device 630, in particular a sealing ring.

As FIG. 21 shows, the base device 600 comprises an in particular slot-like passage which fluidically connects the sensor device 264 to the environment, in particular the water surrounding the apparatus 1. The sensor device 264 is in this way at least substantially protected from unwanted physical influences such as contaminants or impacts while the acquiring of the parameter to be detected, in particular the ambient pressure as a measure of the water depth, is enabled.

By means of multi-pole, in particular 4-pole, contact, the apparatus 1 can be at least intermittently connected to an external control device (not shown) such as for example a personal computer. By so doing, limit valves for the depth and/or maximum length of time below the depth limit value can be adapted according to the level of the person to be monitored and/or data, in particular depth/time profiles, read out, etc.

According to the implementation depicted in FIGS. 22 and 23, a connecting cable 700 is held by a connecting device 710 while the connection to the external control device is held to the base device 600 by an in particular magnetic stop 662.

In order to facilitate the locating of the monitored person upon an emergency, particularly in murky water, the base device 600 furthermore comprises a localization device 330 in the form of an LED, in particular a high-power LED, which preferentially emits a flashing light signal in the event of an emergency.

Although the above is a description of example implementations, it should be noted that a plurality of modifications are possible. It is also to be noted that the example implementations are only examples which are not intended to limit the scope, applicability or configuration in any way. Rather, the foregoing description provides those skilled in the art with a guide for realizing at least one example implementation, whereby various changes may be made, particularly with respect to the function and arrangement of the component parts as described, without departing from the scope of protection as set forth in the claims and their equivalent combinations of features.

LIST OF REFERENCE NUMERALS

1 apparatus for monitoring persons in water; apparatus for short
2 system
10 person
20 surface of water
100 carrier device
110 wristband
200 monitoring device
202 sealing compound
210 display
220 battery
240 motor
242 drive
244 internal thread interface
250 pressure tank
250*a* outlet of pressure tank 250
252 valve
252*a* valve housing of valve 252
252*b* valve pin of valve 252
252*b*1 external thread interface of valve pin 252*b*
252*b*2 limit stop
252*c* actuator device
252*d* force transmission device
252*e* pyrotechnic device
252*e*1 propagation direction
252*f* contact device
252*g* first pressure channel
252*h* sealing ring
252*i* valve pin guide channel
254 gas outlet
256 end piece
258 fill screw
260 plate

262 electric, in particular electronic component
264 sensor device, in particular pressure sensor device
264*a* inlet
300 signaling device
310 flotation body
312 flotation body mount
320 ferroelectric vibrating body
322 connecting cables of the ferroelectric vibrating body
330 localization device
400 base station
410 receiver device
420 transmitter device
500 alarm body
510 alarm body electronics
520 sealing device, in particular sealing ring
540 alarm body battery
550 electrical contact
600 base device
610 base device electronics
620 alarm body support
630 sealing device, in particular sealing ring
640 base device battery
650 electrical contact
660 data interface
662 limit stop
700 connecting cable
710 connecting device
L direction of gas flow
S1 fastening of apparatus
S2 acquisition of sensor data
S3 time tracking
S4 activating of alarm status
S5 signaling device release
S6 signaling device ascent
S7 transmitting of audio signal

The invention claimed is:

1. An apparatus for monitoring persons in water, comprising:

(a) a carrier device which is provided to be fastened onto a person;

(b) a monitoring device which is accommodated by the carrier device and which comprises a sensor device and a processor device, wherein the sensor device is connected to the processor device;

(c) a signaling device which is accommodated by the carrier device and which is connected to the monitoring device; and (d) an actuator, wherein the sensor device is configured to provide a detection result based on a detection of how long the person has been in the water below a predefined depth, wherein the processor device is configured to generate an electrical signal based on the detection result, wherein the signaling device comprises a flotation body, wherein the signaling device is configured to at least partly detach from the carrier device and rise to a water surface upon the electrical signal of the processor device, and wherein the actuator is connected to the flotation body and the actuator brings the flotation body from a first state, in which the flotation body is not buoyant, into a second state, in which the flotation body is buoyant.

2. The apparatus according to claim 1, wherein the flotation body is a substantially gas-tight body which enlarges in volume upon an inflow of gas.

3. The apparatus according to claim 1, wherein the actuator is provided to bring, upon the electrical signal from the processor device, the flotation body from the first state into the second state.

4. The apparatus according to claim 3, wherein the apparatus further comprises a pressure tank, and wherein the actuator comprises:

(a) a pyrotechnic device which is provided to enable a gas-conducting connection between the pressure tank and the flotation body upon the electrical signal from the processor device; and/or (b) a drive device, which is provided to enable a gas-conducting connection between the pressure tank and the flotation body upon the electrical signal from the processor device.

5. The apparatus according to claim 1, wherein the apparatus further comprises a gas feed device comprising one or more selected from:

1) a pressure tank which is provided to take in pressurized gas and feed it to the flotation body upon the electrical signal of the processor device;

2) a container which is provided to take in a liquid gas which at least partly changes into the gaseous state upon the electrical signal of the processor device and is fed to the flotation body;

3) a pyrotechnic component which is provided to burn upon the electrical signal of the processor device and feed thereby resulting gas to the flotation body; and 4) a powdered and/or solid first substance which is provided to come into contact with a second substance upon the electrical signal of the processor device, wherein a gas is produced which is fed to the flotation body.

6. The apparatus according to claim 1, wherein the signaling device is provided to emit one or more selected from: an audio signal, a visual signal, and a radio signal, as soon as the signaling device is at least partly detached from the carrier device at the water surface.

7. The apparatus according to claim 1, wherein the signaling device is provided to emit an audio signal audible to the human ear at a volume of at least 80 decibels.

8. The apparatus according to claim 1, wherein the signaling device comprises a vibrating body which produces a sound able to be perceived by the human ear.

9. The apparatus according to claim 1 which further comprises a protective cover arranged on the carrier device and which covers at least the signaling device, wherein the protective cover is provided to at least partly disengage from the carrier device upon the electrical signal from the processor device so that the signaling device is exposed subsequent the disengaging.

10. The apparatus according to claim 9, wherein the apparatus comprises a further actuator which is provided to at least partially uncover and/or at least partially disengage the protective cover from the carrier device upon the electrical signal of the processor device.

11. The apparatus according to claim 1, wherein the sensor device is a pressure sensor device which is provided to supply a signal from which the processor device can directly deduce or indirectly calculate whether the person is located in the water.

12. The apparatus according to claim 1, wherein the monitoring device comprises a time-measuring device, wherein the monitoring device is provided to start tracking time upon a signal of the sensor device.

13. The apparatus according to claim 12, wherein the monitoring device transmits the signal to the signaling device which prompts the signaling device to at least partially detach from the carrier device and rise to the water surface when a time period determined in a course of a time measurement exceeds a predefined length.

14. A system for monitoring persons in water, comprising:

at least one apparatus for monitoring persons in water in accordance with claim 1; and at least one base station which is provided to detect the signaling device at the water surface by means of a receiver device and which is provided to emit one or more selected from: a further audio signal, a further visual signal, a further radio signal, and an electrical signal, by means of a transmitter device.

15. The system for monitoring persons in water according to claim 14, wherein the base station is provided to receive one or more selected from: an audio signal, a visual signal, and a radio signal, from the signaling device by means of the receiver device, wherein the signal is a signal at a predefined frequency and the base station is provided to substantially only be responsive to a signal at said predefined frequency.

16. A method for monitoring persons in water, comprising the steps:

S1 fastening the apparatus for monitoring persons in accordance with claim 1 onto a person;

S2 detecting by means of the sensor device whether the person is located in the water;

S3 detecting by means of the time-measuring device of the monitoring device how long the person remains in the water;

S4 an emergency being determined as soon as the person remains in the water for longer than a predefined length of time;

S5 the signaling device at least partly detaching from the carrier device upon the signal of the processor device;

S6 the signaling device rising to the water surface; and

S7 the signaling device emitting an audio signal, a visual signal, and/or a radio signal.

17. The use of the apparatus for monitoring persons in water in accordance with claim 1 for protecting persons from dangers posed by lack of oxygen.

18. The apparatus according to claim 9, wherein the protective cover is permeable by water.

19. The apparatus according to claim 1, wherein the signaling device is configured to detach completely from the carrier device and rise to the water surface upon the electrical signal of the processor device.

20. A signaling device for use in an apparatus for monitoring persons in water and connected to a monitoring device, the signaling device comprising a flotation body which is arranged to be brought, by an actuator, from a first state in which the flotation body is not buoyant into a second state in which the flotation body is buoyant, wherein the monitoring device comprises a sensor device, wherein the sensor device is configured to provide a detection result based on a detection of how long the person has been in the water below a predefined depth, wherein the signaling device is capable of being received by a carrier device and is configured to at least partly detach from the carrier device and rise to a water surface upon a signal based on the detection result.

21. The signaling device according to claim 20, wherein the signaling device is configured to detach completely from the carrier device and rise to the water surface upon the signal.

* * * * *